US012338825B2

(12) United States Patent
Yamaguchi et al.

(10) Patent No.: US 12,338,825 B2
(45) Date of Patent: Jun. 24, 2025

(54) BEARING STRUCTURE, COMPRESSOR, AND REFRIGERATION CYCLE APPARATUS WITH FOREIGN MATTER SEPARATOR

(71) Applicant: Mitsubishi Electric Corporation, Tokyo (JP)

(72) Inventors: Yoshifumi Yamaguchi, Tokyo (JP); Daisuke Katagiri, Tokyo (JP); Shinichiro Ido, Tokyo (JP); Hiroyuki Yamada, Tokyo (JP); Nobukazu Kosone, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 18/291,250

(22) PCT Filed: Jun. 16, 2022

(86) PCT No.: PCT/JP2022/024058
§ 371 (c)(1),
(2) Date: Jan. 23, 2024

(87) PCT Pub. No.: WO2023/021829
PCT Pub. Date: Feb. 23, 2023

(65) Prior Publication Data

US 2025/0101985 A1 Mar. 27, 2025

(30) Foreign Application Priority Data

Aug. 20, 2021 (JP) ..... 2021-134809

(51) Int. Cl.
*F04C 29/02* (2006.01)
*F04B 39/02* (2006.01)

(52) U.S. Cl.
CPC ..... *F04C 29/02* (2013.01); *F04B 39/02* (2013.01); *F04C 29/026* (2013.01); *F04C 2240/50* (2013.01)

(58) Field of Classification Search
CPC .... F04C 29/02; F04C 29/026; F04C 2240/50; F04B 39/02
See application file for complete search history.

(56) References Cited

U.S. PATENT DOCUMENTS

2016/0047381 A1 2/2016 Tanaka et al.

FOREIGN PATENT DOCUMENTS

DE 102021122169 A1 * 3/2023 ..... F01D 25/12
JP S53-007708 U 1/1978
(Continued)

OTHER PUBLICATIONS

International Search Report and Written Opinion mailed on Aug. 2, 2022, received for PCT Application PCT/JP2022/024058, filed on Jun. 16, 2022, 9 pages including English Translation.
(Continued)

*Primary Examiner* — Mary A Davis
(74) *Attorney, Agent, or Firm* — XSENSUS LLP

(57) ABSTRACT

A rotary machine includes a rotor having a cylindrical shape and having a main oil feed hole through which lubricating oil passes and that is provided in an axial direction and a slide bearing provided outward in a radial direction with a gap between the rotor and the slide bearing and configured to hold the rotor so that the rotor rotates around an axis. The rotor is provided with a branch oil feed hole through which the gap and the main oil feed hole communicate with each other and through which the lubricating oil passes. A foreign matter separating portion configured to separate foreign
(Continued)

matter from the lubricating oil is provided further backward in a direction of rotation of the rotor than the branch oil feed hole.

9 Claims, 16 Drawing Sheets

(56) References Cited

FOREIGN PATENT DOCUMENTS

| | | | |
|---|---|---|---|
| JP | 2003-042080 | A | 2/2003 |
| JP | 2004-162837 | A | 6/2004 |
| JP | 2009-167849 | A | 7/2009 |
| JP | 2015-161209 | A | 9/2015 |
| WO | 2014/155923 | A1 | 10/2014 |
| WO | WO-2017145281 | A1 * | 8/2017 |

OTHER PUBLICATIONS

Notice of Reasons for Refusal mailed on Mar. 14, 2023, received for JP Application 2022-578668, 10 pages including English Translation.

* cited by examiner

BEARING STRUCTURE, COMPRESSOR, AND REFRIGERATION CYCLE APPARATUS WITH FOREIGN MATTER SEPARATOR

CROSS-REFERENCE TO RELATED APPLICATIONS

This application is based on PCT filing PCT/JP2022/024058, filed Jun. 16, 2022, which claims priority from Japanese Patent Application No. 2021-134809, filed Aug. 20, 2021, the entire contents of each are incorporated herein by reference.

TECHNICAL FIELD

The present disclosure relates to a bearing structure including a shaft provided with an oil feed hole and a slide bearing configured to support the shaft, a compressor, and a refrigeration cycle apparatus.

BACKGROUND ART

In general, a rotary machine such as a compressor includes a bearing structure including a shaft configured to rotate and a slide bearing configured to hold the shaft so that the shaft can rotate. The shaft is provided with an oil feed hole through which lubricating oil is supplied to sliding parts of the shaft and the slide bearing. There is a conventional compressor including a main oil feed hole provided inside a shaft and extending in an axial direction and a branch oil feed hole branching off from the main oil feed hole in a radial direction of the shaft (see, for example, Patent Literature 1). While the shaft is rotating, lubricating oil in the main feed oil hole is subjected to centrifugal force acting outward in the radial direction, whereby the lubricating oil flows from the main oil feed hole to the branch oil feed hole and is supplied to sliding parts of the shaft and a slide bearing. One possible factor that causes abrasion on the sliding parts is that foreign matter such as abrasion powder generated on the sliding parts is supplied together with the lubricating oil to the sliding parts via an oil feed structure of the shaft. The foreign matter supplied together with the lubricating oil to the sliding parts is carried in a direction of rotation of the shaft along with sliding movements of the shaft and the slide bearing while being sandwiched between an outer circumferential surface of the shaft and an inner circumferential surface of the slide bearing. At this point in time, the outer circumferential surface of the shaft and the inner circumferential surface of the slide bearing are scraped against by the foreign matter, whereby abrasion occurs on the sliding parts to generate abrasion powder to further increase the amount of foreign matter (including abrasion powder) inside the compressor. Accordingly, abrasion of the slide bearing and the shaft by the foreign matter is effectively reduced by separating the foreign matter from the lubricating oil.

In the compressor of Patent Literature 1, an oil feed groove communicating with the branch oil feed hole and extending in the axial direction is provided in a location on the outer circumferential surface of the crank shaft (shaft) where the branch oil feed hole is provided in a circumferential direction and that is furthest forward in the direction of rotation of the crank shaft. Further, in the compressor of Patent Literature 1, a drain groove not communicating with the branch oil feed hole but extending in the axial direction is provided in a location on the outer circumferential surface of the crank shaft that is further backward in the direction of rotation than the location where the oil feed groove is provided in the circumferential direction, and a sliding area is formed between the oil feed groove and the drain groove. The compressor of Patent Literature 1 is configured such that of the foreign matter supplied to the gap between the crank shaft and the slide bearing via the branch oil feed hole, foreign matter of a certain size (e.g. foreign matter that is larger than this gap) is either drained out of the bearing structure by being trapped in the oil feed groove immediately after leaving an oil feed port or drained out of the bearing structure by being trapped in the drain groove after leaving the oil feed port and passing through the sliding area.

CITATION LIST

Patent Literature

Patent Literature 1: Japanese Unexamined Patent Application Publication No. 2015-161209

SUMMARY OF INVENTION

Technical Problem

However, in the compressor of Patent Literature 1, since foreign matter separating spaces such as the oil feed groove and the drain groove are provided further backward than, that is, downstream of, the oil feed port in the direction in which the lubricating oil flows, the amount of foreign matter that is supplied to the gap between the slide bearing and the crank shaft cannot be reduced. Further, in the compressor of Patent Literature 1, a portion of the foreign matter supplied to the gap between the slide bearing and the crank shaft that has a size about equal to or smaller than the gap (clearance) between the slide bearing and the crank shaft remains without being trapped in the oil feed groove or the drain groove and abrades the sliding parts. Accordingly, Patent Literature 1 cannot sufficiently bring about an effect of reducing abrasion on sliding parts of a rotor such as a shaft and a slide bearing.

The present disclosure was made to solve problems such as those noted above and has as an object to provide a bearing structure, a compressor, and a refrigeration cycle apparatus with an ever-further reduction in abrasion on sliding parts of a rotor and a slide bearing.

Solution to Problem

A bearing structure according to an embodiment of the present disclosure is a rotary machine including a rotor having a cylindrical shape and having a main oil feed hole through which lubricating oil passes and that is provided in an axial direction and a slide bearing provided outward in a radial direction with a gap between the rotor and the slide bearing and configured to hold the rotor so that the rotor rotates around an axis. The rotor is provided with a branch oil feed hole through which the gap and the main oil feed hole communicate with each other and through which the lubricating oil passes. A foreign matter separating portion configured to separate foreign matter from the lubricating oil is provided further backward in a direction of rotation of the rotor than the branch oil feed hole.

Further, a compressor according to an embodiment of the present disclosure includes the bearing structure and a closed vessel housing the bearing structure.

Further, a refrigeration cycle apparatus according to an embodiment of the present disclosure includes a refrigerant circuit in which the compressor, an evaporator, a pressure reducing device, and a condenser are connected via refrigerant pipes.

Advantageous Effects of Invention

According to an embodiment of the present disclosure, a foreign matter separating portion configured to separate foreign matter from lubricating oil is provided further backward in the direction of rotation than the branch oil feed hole. Therefore, even in a case in which foreign matter is contained in lubricating oil flowing through the rotor, the action of inertial force on lubricating oil and foreign matter flowing through the branch oil feed hole is utilized so that foreign matter that is higher in density than the lubricating oil can be separated from the lubricating oil in the foreign matter separating portion. This inhibits foreign matter from being supplied from the branch oil feed hole of the rotor to the gap between the rotor and the slide bearing, thus making it possible to further reduce abrasion on sliding parts of the slide bearing and the shaft than has conventionally been the case.

DESCRIPTION OF EMBODIMENTS

Embodiment 1

Figure 1:
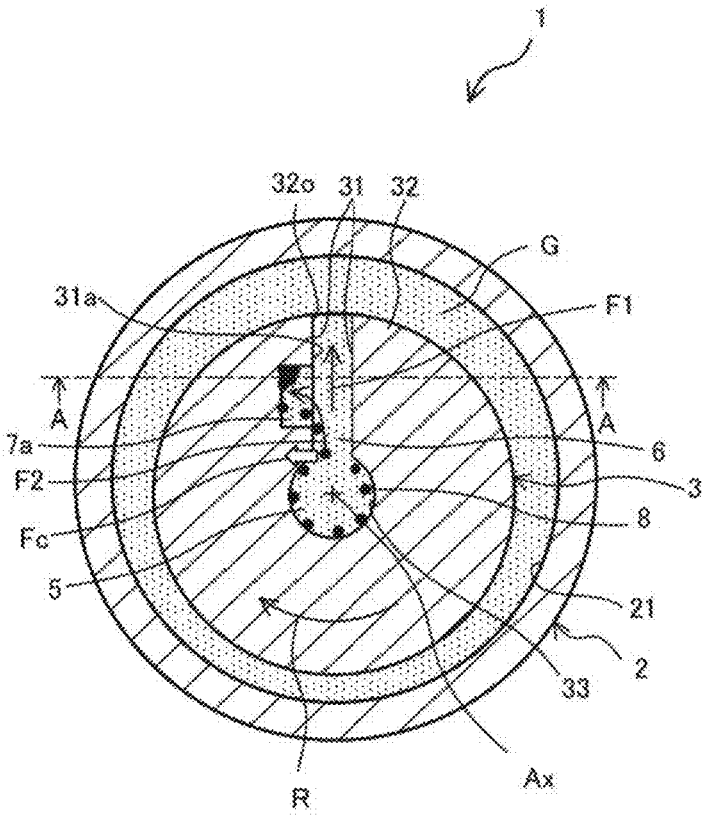
FIG. 1 is a cross-sectional view of a bearing structure according to Embodiment 1.
Figure 2:
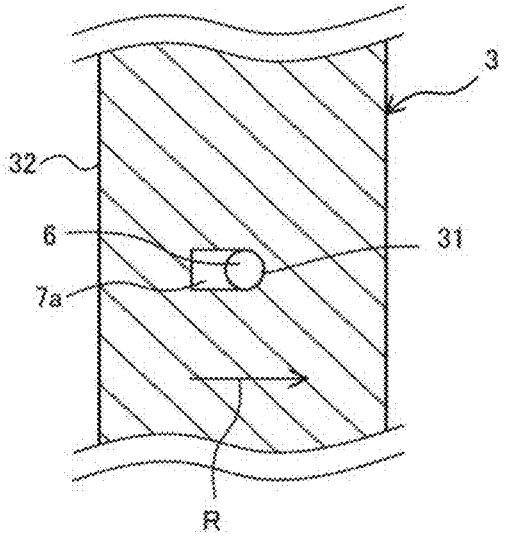
FIG. 2 is a longitudinal sectional view of a shaft as taken along line A-A in FIG. 1.

FIG. 1 is a cross-sectional view of a bearing structure 1 according to Embodiment 1. FIG. 2 is a longitudinal sectional view of a shaft 3 as taken along line A-A in FIG. 1. The bearing structure 1 is provided in a rotary machine such as a compressor 12 (see FIG. 28, which will be described below). The following describes a configuration of the bearing structure 1 with reference to FIGS. 1 and 2.

As shown in FIG. 1, the bearing structure 1 includes a rotor having a cylindrical shape and a slide bearing 2 provided outward in a radial direction of the rotor. The slide bearing 2 has a cylindrical shape and is fixed to a closed vessel 103 (see FIG. 28, which will be described below) of the rotary machine. The rotor is inserted in the slide bearing 2, and is held by the slide bearing 2 so that the rotor can rotate around an axis Ax.

In Embodiment 1, the rotor is constituted by the shaft 3, and an outer circumferential portion 32 of the shaft 3 slides over an inner circumferential surface 21 of the slide bearing 2. A gap G (i.e. a clearance) is formed between the outer circumferential portion 32 of the shaft 3 and the inner circumferential surface 21 of the slide bearing 2.

Inside the shaft 3, a main oil feed hole 5 through which lubricating oil flows is provided in an axial direction. The term "axial direction" here means a direction in which the axis Ax of the shaft 3 extends. The main oil feed hole 5 has a substantially cylindrical shape whose central axis is the axis Ax of the shaft 3 and has an opening at a lower end of the shaft 3 in the axial direction. As the shaft 3 rotates, the lubricating oil flows into the main oil feed hole 5 via the opening. The lubricating oil in the main oil feed hole 5 may flow in the axial direction and be pressure-fed by an oil feed pump or other devices.

Further, the shaft 3 is provided with a columnar branch oil feed hole 6 branching off from the main oil feed hole 5 outward in the radial direction. The branch oil feed hole 6 has an inlet in an inner circumferential surface 33 of the shaft 3 and an outlet 320 in the outer circumferential portion 32 of the shaft 3 so that the gap G between the shaft 3 and the slide bearing 2 and the main oil feed hole 5 communicate with each other. As the shaft 3 rotates, the lubricating oil flowing into the main oil feed hole 5 passes through the branch oil feed hole 6 and is drained via the outlet 320.

The gap G between the outer circumferential portion 32 of the shaft 3 and the inner circumferential surface 21 of the slide bearing 2 is filled with lubricating oil drained from the branch oil feed hole 6 of the shaft 3. Friction between the inner circumferential surface 21 of the slide bearing 2 and the outer circumferential portion 32 of the shaft 3 during rotation of the shaft 3 is reduced by the lubricating oil.

The lubricating oil in the main oil feed hole 5 may contain foreign matter 8 such as abrasion powder. The foreign matter 8 such as abrasion powder is generated, for example, on sliding parts or other parts of the slide bearing 2 and the shaft 3. The foreign matter 8 circulates through the closed vessel of the rotary machine together with the lubricating oil. Therefore, if the foreign matter 8 is supplied directly to the gap between the slide bearing 2 and the shaft 3 without being separated from the lubricating oil, the foreign matter 8 may cause further abrasion to increase in amount.

To address this problem, a structure for separation of foreign matter (hereinafter also referred to as "foreign matter separating portion") is provided in a flow passage of the lubricating oil up to the supply of the lubricating oil to the gap G between the sliding parts of the slide bearing 2 and the shaft 3. There are three options of where to provide a foreign matter separating portion: a place in the branch oil feed hole 6 of the shaft 3 that is at or close to the outlet 320, a place in the middle of the branch oil feed hole 6, and a place in the branch oil feed hole 6 that is at or close to the inlet. In one configuration, a foreign matter separating portion may be provided in one of the three places. In an alternative configuration, foreign matter separating portions may be provided in two or more of the three places.

In the bearing structure 1 of Embodiment 1, a foreign matter separating portion configured to separate the foreign matter 8 from the lubricating oil is provided in the middle of the branch oil feed hole 6. Specifically, a recessed foreign matter separating space 7*a* serving as a foreign matter separating portion is provided in an inner wall portion 31*a* of an inner wall 31 of the branch oil feed hole 6 that is backward in a direction of rotation (direction of an arrow R) and upstream from the outlet 320. In other words, the foreign matter separating space 7*a* is not connected directly to the main oil feed hole 5 and communicates with the main oil feed hole 5 via part of the branch oil feed hole 6 that is at or close to the inlet, and is not connected directly to the gap G and communicates with the gap G via part of the branch oil feed hole 6 that is at or close to the outlet 320.

A mechanism by which, in a case in which foreign matter 8 is contained in the lubricating oil in the main oil feed hole 5, the foreign matter 8 is separated from the lubricating oil prior to the supply of the lubricating oil to the gap G is described with reference to FIG. 1. The lubricating oil present in the main oil feed hole 5 of the shaft 3 in rotation forms a swirl flow in the same direction of rotation (direction of the arrow R) as the shaft 3. Foreign matter 8 present in lubricating oil forming a swirl flow is subjected to centrifugal force and therefore pressed against the inner circumferential surface 33 of the shaft 3, that is, an inner wall surface of the main oil feed hole 5. At this point in time, foreign matter 8 present at a boundary between the branch oil feed hole 6 and the main oil feed hole 5 is released together with the lubricating oil by centrifugal force into the branch oil feed hole 6, which is further outward in the radial direction than the main oil feed hole 5.

Further, in a rotating system of coordinates that rotates at the same angular velocity as the shaft 3, the foreign matter 8 is subjected to not only the centrifugal force but also Coriolis force (indicated by an outline arrow Fc in FIG. 1) serving as an apparent force and acting in a direction opposite to the direction of rotation (direction of the arrow R) of the shaft 3. This Coriolis force causes the foreign matter 8 to, as indicated by an arrow F2 in the drawing, move in a trajectory that continuously approaches the inner wall portion 31*a* in the inner wall 31 of the branch oil feed hole 6 that is backward in the direction of rotation (direction of the arrow R).

Meanwhile, a similar Coriolis force acts on lubricating oil inside the branch oil feed hole 6; however, due to a density difference between the lubricating oil and the foreign matter 8, the Coriolis force acting on the foreign matter 8 is greater than the Coriolis force acting on the lubricating oil. Therefore, the trajectory of the foreign matter 8 indicated by the arrow F2 in the drawing is curved further backward in the direction of rotation than a trajectory of the lubricating oil indicated by an arrow F1 in the drawing, so that the foreign matter 8 and the lubrication oil separate from each other inside the branch oil feed hole 6. Moreover, the foreign matter 8 moving to continuously approach the inner wall portion 31*a* that is backward in the direction of rotation (direction of the arrow R) enters the foreign matter separating space 7*a* provided in the inner wall portion 31*a* and is trapped upstream from the outlet 320.

In the example shown in FIG. 2, the foreign matter separating space 7*a* is provided such that the width of the foreign matter separating space 7*a* in the axial direction, which is the direction in which the axis Ax extends, (in FIG. 2, an up-down direction on the surface of paper) is equal to the width of the branch oil feed hole 6 in the axial direction (i.e. the diameter of the branch oil feed hole 6; hereinafter referred to as "width of the branch oil feed hole 6 in the axial direction"). Even in a case in which the width of the foreign matter separating space 7*a* in the axial direction is shorter than the width of the branch oil feed hole 6 in the axial direction, a certain effect of trapping the foreign matter 8 upstream from the outlet 320 of the branch oil feed hole 6 is brought about. Note, however, that it is desirable to make the width of the foreign matter separating space 7*a* in the axial direction greater than or equal to the width of the branch oil feed hole 6 in the axial direction, as doing so allows more foreign matter 8 to flow into the foreign matter separating space 7*a* in the branch oil feed hole 6.

The rotor of Embodiment 1 is constituted by the shaft 3, and in the example shown in FIGS. 1 and 2, at least a portion of the shaft 3 that faces the slide bearing 2 is constituted by a single component. Such a rotor, that is, the shaft 3, can be manufactured, for example, by using a 3D printer. Using the 3D printer makes it possible to provide a foreign matter separating space 7*a* in the middle of the inner wall 31 of the branch oil feed hole 6 and configure the shaft 3 to be seamless and inseparable. Using the 3D printer makes it possible to easily form a complex foreign matter separating space 7*a* in the branch oil feed hole 6.

As noted above, a bearing structure 1 according to Embodiment 1 includes a rotor having a cylindrical shape and having a main oil feed hole 5 through which lubricating oil passes and that is provided in an axial direction and a slide bearing 2 provided outward in a radial direction with a gap G between the rotor and the slide bearing and configured to hold the rotor so that the rotor rotates around an axis. The rotor is provided with a branch oil feed hole 6 through which the gap G and the main oil feed hole 5 communicate with each other and through which the lubricating oil passes. A foreign matter separating portion (e.g. a foreign matter separating space 7*a*) configured to separate foreign matter from the lubricating oil is provided further backward in a direction of rotation of the rotor (i.e. further forward in a direction opposite to the direction of rotation) than the branch oil feed hole 6.

According to this configuration, a foreign matter separating portion configured to separate the foreign matter 8 from the lubricating oil is provided further backward in the direction of rotation (direction of the arrow R) than the branch oil feed hole 6. Therefore, even in a case in which foreign matter 8 is contained in lubricating oil flowing through the rotor, the action of inertial force on lubricating oil and foreign matter 8 flowing through the branch oil feed hole 6 is utilized so that foreign matter 8 that is higher in density than the lubricating oil can be separated from the lubricating oil in the foreign matter separating portion. This inhibits foreign matter 8 from being supplied from the branch oil feed hole 6 of the rotor to the gap between the rotor and the slide bearing 2, thus making it possible to further reduce abrasion on sliding parts of the slide bearing 2 and the shaft 3 than has conventionally been the case.

Further, the foreign matter separating portion is a recessed foreign matter separating space 7*a* provided in an inner wall portion 31*a* of an inner wall 31 of the branch oil feed hole 6 that is backward in the direction of rotation. According to this configuration, even if foreign matter 8 moves from the main oil feed hole 5 of the rotor to the branch oil feed hole 6 with the flow of lubricating oil, the action of Coriolis force, which is a type of inertial force, on lubricating oil and foreign matter 8 flowing through the branch oil feed hole 6 is utilized so that foreign matter 8 that is higher in density than the lubricating oil can be separated from the lubricating oil by flowing into the foreign matter separating space 7*a*. This makes it possible to reduce the supply of foreign matter 8 to the sliding parts of the slide bearing 2 and the rotor.

Further, the foreign matter separating space 7*a* has, in the axial direction, a width that is greater than or equal to a width of at least the branch oil feed hole 6 in the axial direction. This better allows more foreign matter 8 to flow into the foreign matter separating space 7*a* in the branch oil feed hole 6.

Figure 3:
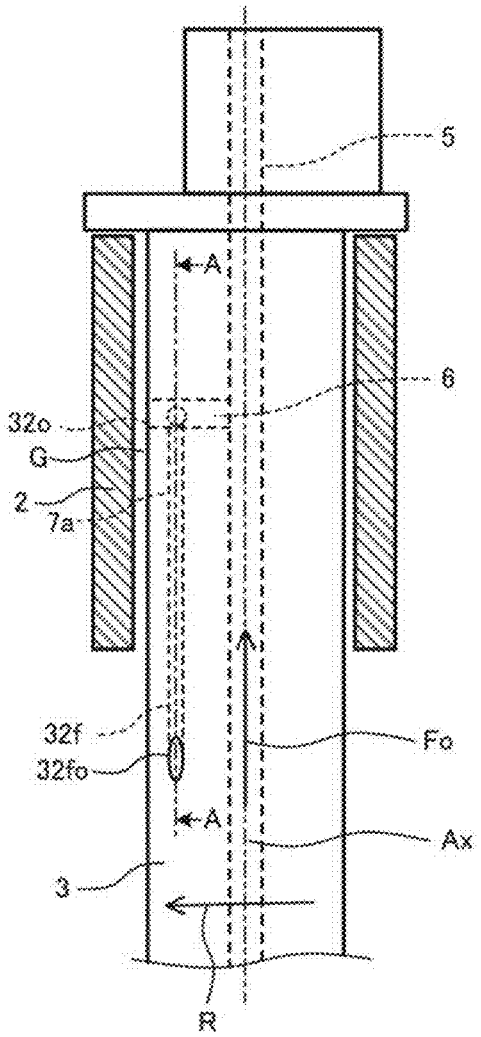
FIG. 3 is a longitudinal sectional view showing a modification of a foreign matter separating space of the bearing structure according to Embodiment 1 with an outer circumferential surface of the shaft exposed by cutting a slide bearing of the bearing structure.
Figure 4:
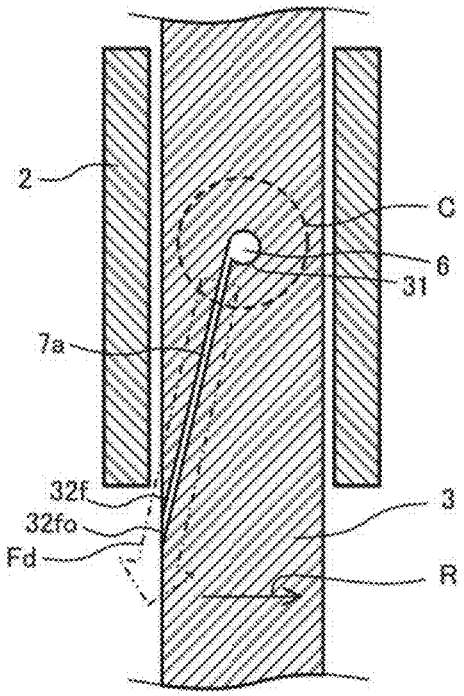
FIG. 4 is a longitudinal sectional view of the shaft as taken along line A-A in FIG. 3.
Figure 5:
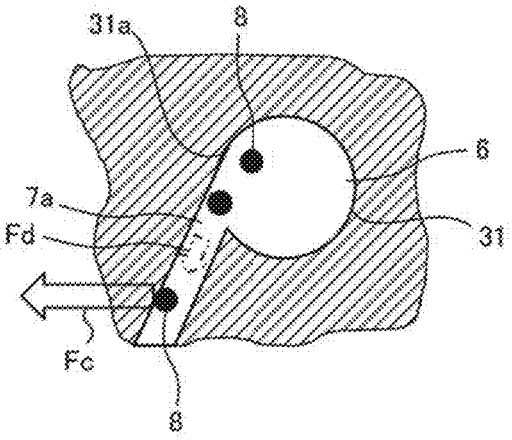
FIG. 5 is a partially enlarged view of a portion of the shaft of FIG. 4 surrounded by a dashed line C including a branch oil feed hole and an area therearound.

FIG. 3 is a longitudinal sectional view showing a modification of the foreign matter separating space 7*a* of the bearing structure 1 according to Embodiment 1 with an outer circumferential surface of the shaft 3 exposed by cutting the slide bearing 2 of the bearing structure. FIG. 4 is a longitudinal sectional view of the shaft 3 as taken along line A-A in FIG. 3. FIG. 5 is a partially enlarged view of a portion of the shaft 3 of FIG. 4 surrounded by a dashed line C including the branch oil feed hole 6 and an area therearound. In each of FIGS. 4 and 5, a direction of drainage of foreign matter 8 is indicated by a chain double-dashed outline arrow Fd. Further, in FIG. 5, a direction of action of Coriolis force is indicated by a solid outline arrow Fc.

As shown in FIG. 3, a foreign matter drain hole 32*f* communicating with the outside of the shaft 3 is provided in the middle of the branch oil feed hole 6. The shaft 3 rotates clockwise when viewed directly above from the shaft 3 in a direction parallel with the shaft length in FIGS. 3 to 5 (see the arrow R in FIG. 1). In this case, as shown in FIGS. 4 and 5, Coriolis force acts on foreign matter particles backward in the direction of rotation (see the outline arrow Fc in FIG. 5). For this reason, the foreign matter drain hole 32*f* is provided to extend backward in the direction of rotation from the inner wall 31 of the branch oil feed hole 6. Further, the foreign matter drain hole 32*f* is provided to extend downward in the axial direction from the inner wall 31 of the branch oil feed hole 31, and the foreign matter drain hole 32*f* has an exit 32*fo* provided outside a sliding part, that is, a portion of the outer circumferential surface of the shaft 3 exposed from the slide bearing 2. It is preferable that the foreign matter drain hole 32*f* extend downward in the axial direction, although the foreign matter drain hole 32*f* may extend upward or downward in the axial direction. A reason for this is that when the foreign matter drain hole 32*f* extends downward in the axial direction, foreign matter 8 that is higher in density than the lubricating oil is easily separated from the flow of lubricating oil and drained. The diameter of the foreign matter drain hole 32*f* needs to be larger than the size of foreign matter particles. Meanwhile, when the diameter of the foreign matter drain hole 32*f* is too large, the amount of oil that is supplied to the gap G (see FIG. 3) formed between the slide bearing 2 and the shaft 3 decreases. Therefore, it is preferable that the diameter of the foreign matter drain hole 32*f* be at most approximately one-fifth of the diameter of the branch oil feed hole 6.

As noted above, in the modification shown in FIGS. 3 to 5, the rotor is a shaft 3 supported to slide directly on the inner circumferential surface 21 of the slide bearing 2 and includes a foreign matter drain hole 32*f* provided to extend backward in the direction of rotation from the branch oil feed hole 6 of the rotor. Moreover, the foreign matter separating space 7*a* is formed by the branch oil feed hole 6 and the foreign matter drain hole 32*f* of the shaft 3.

According to this configuration, the foreign matter separating space 7*a* is constituted by the foreign matter drain hole 32*f* shown in FIG. 4. Therefore, in comparison with a case in which the foreign matter separating space 7*a* is in the shape of a recess as shown in FIG. 1, flows of lubricating oil and foreign matter 8 toward the exit 32*fo* are generated in the foreign matter separating space 7*a*. Moreover, since the foreign matter drain hole 32*f* is provided to extend backward in the direction of rotation from the branch oil feed hole 6, foreign matter 8 that is higher in density than the lubricating oil easily flows into the foreign matter drain hole 32*f* when the lubricating off and the foreign matter 8 pass through the branch oil feed hole 6. This makes it easy to separate the foreign matter 8.

Embodiment 2

Figure 6:
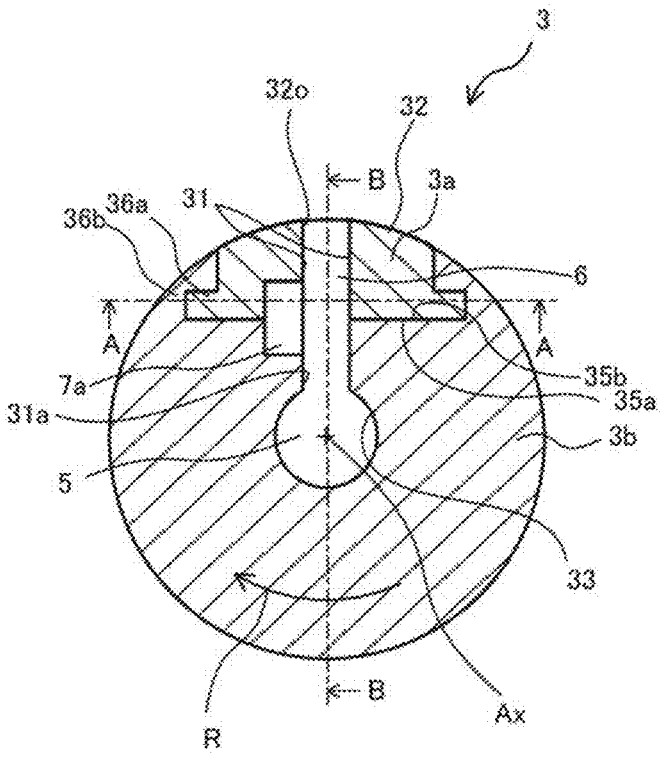
FIG. 6 is a cross-sectional view of a shaft of a bearing structure according to Embodiment 2.
Figure 7:
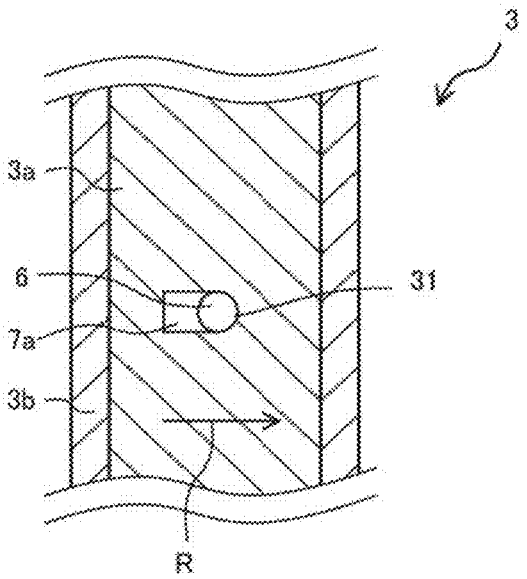
FIG. 7 is a longitudinal sectional view taken along line A-A in FIG. 6.
Figure 8:
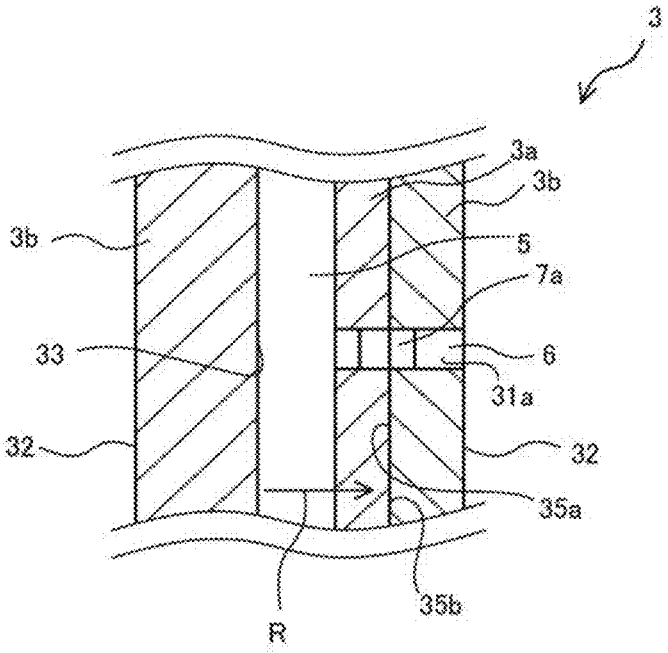
FIG. 8 is a longitudinal sectional view taken along line B-B in FIG. 6.

FIG. 6 is a cross-sectional view of a shaft 3 of a bearing structure 1 according to Embodiment 2. FIG. 7 is a longitudinal sectional view taken along line A-A in FIG. 6. FIG. 8 is a longitudinal sectional view taken along line B-B in FIG. 6.

As shown in FIGS. 6 to 8, in the bearing structure 1 of Embodiment 2 too, as in the case of Embodiment 1, the rotor is constituted by the shaft 3, and an outer circumferential portion 32 of the shaft 3 slides over an inner circumferential surface 21 of the slide bearing 2. Further, in Embodiment 2 too, as in the case of Embodiment 1, the shaft 3 is provided with a main oil feed hole 5, a branch oil feed hole 6, and a foreign matter separating space 7*a*.

Embodiment 2 is different from Embodiment 1 in that the shaft 3 is constituted by a plurality of elements so that the branch oil feed hole 6 is divided. In other respects, Embodiment 2 is identical to Embodiment 1. Components of Embodiment 2 that are identical to those of Embodiment 1 are given identical reference signs, and Embodiment 2 is described with a focus on differences from Embodiment 1.

An example configuration of the shaft 3 is described with reference to FIGS. 6 to 8. As shown in FIG. 6, the shaft 3 is constituted by a second element 3*b* constituting a large portion of the shaft 3 and a first element 3*a* constituting part of an outer circumferential side of the shaft 3. The second element 3*b* includes the main oil feed hole 5 and portions of the branch oil feed hole 6 and the foreign matter separating space 7*a* that are close to the main oil feed hole 5. Further, the first element 3*a* includes portions of the branch oil feed hole 6 and the foreign matter separating space 7*a* that are close to the outlet 320. That is, the first element 3*a* and the second element 3*b* are assembled together, whereby the branch oil feed hole 6 and the foreign matter separating space 7*a* of the shaft 3 are formed.

The first element 3*a* has a first planar portion 35*a* intersecting at a right angle with the center line of the branch oil feed hole 6 and passing through the foreign matter separating space 7*a*, and the second element 3*b* too has a second planar portion 35*b* intersecting at a right angle with the center line of the branch oil feed hole 6 and passing through the foreign matter separating space 7*a*. The first planar portion 35*a* and the second planar portion 35*b* are each a plane substantially parallel to the axis Ax. It should be noted that FIG. 6 omits to illustrate the center line of the branch oil feed hole 6, as the center line of the branch oil feed hole 6 overlaps line B-B.

First fitting portions 36*a* constituted, for example, by indented surfaces are formed at both ends of the first planar portion 35*a* in the first element 3*a* in a transverse direction, and second fitting portions 36*b* constituted, for example, by indented surfaces to fit the first fitting portions 36*a* are formed at both ends of the second planar portion 35*b* in the first element 3*b* in a transverse direction. The second fitting portions 36*b* of the second element 3*b* form a pair of lugs (not illustrated) provided to wrap around an outer circumferential side of the first element 3*a*, and by this pair of lugs, the first element 3*a* is configured not to fall off outward in a radial direction of the second element 3*b*. The fit between the first fitting portions 36*a* and the second fitting portions 36*b* causes the first planar portion 35*a* of the first element 3*a* and the second planar portion 35*b* of the second element 3*b* to face each other.

Next, a method for manufacturing such a shaft 3 is described. First, as shown in FIG. 6, part of an outer circumferential side of a cylindrically shaped shell element having a main oil feed hole 5 is detached from the other part, whereby a first element 3*a* and a second element 3 are formed. At this point in time, on both sides in a transverse direction, the shell element is divided at indented surfaces, whereby first fitting portions 36*a* and second fitting portions 36*b* are formed. Further, in a central part in a transverse direction, the shell element is divided at a plane parallel to the axis Ax, whereby a first planar portion 35*a* and a second planar portion 35*b* are formed. Part of the outer circumferential side serves as the first element 3*a*, and the other part serves as the second element 3*b*.

Further, as shown in FIG. 7, a columnar branch oil feed hole 6 passing from an outer circumferential portion of the shell element to the main oil feed hole 5 is bored at a predetermined height in the axial direction through the shell element. The branch oil feed hole 6 is provided in a radial direction to pass through the first element 3*a* and the second element 3*b*. After that, the first element 3*a* and the second element 3*b* are detached from each other by withdrawing the first element 3*a* from the second element 3*b* in the axial direction.

As shown in FIG. 8, after the first element 3*a* and the second element 3*b* have been detached from each other, a foreign matter separating space 7*a* is formed in the first element 3*a* and the second element 3*b*. In the example shown in FIGS. 6 to 8 of Embodiment 2, the shaft 3 is divided into the first element 3*a* and the second element 3*b* so that the branch oil feed hole 6 is divided in the radial direction of the shaft 3; therefore, the foreign matter separating space 7*a* can be formed by milling. Specifically, the foreign matter separating space 7*a* can be formed by performing milling from the first planar portion 35*a* in the first element 3*a* and performing milling from the second planar portion 35*b* in the second element 3*b*.

After that, the first element 3*a* and the second element 3*b* are assembled together so that the first fitting portions 36*a* of the first element 3*a* and the second fitting portions 36*b* of the second element 3*b* engage with each other, whereby the branch oil feed hole 6 and the foreign matter separating space 7*a* are formed.

In the manufacturing method, the timing of execution of the step of forming the branch oil feed hole 6 is not limited to the aforementioned timing. For example, the step of forming the branch oil feed hole 6 may be executed prior to the step of separating the shell element into the first element 3*a* and the second element 3*b*.

Further, the number of elements that constitute the shaft 3 and the shape of each element that constitutes the shaft 3 are not particularly limited to those noted above.

Figure 9:
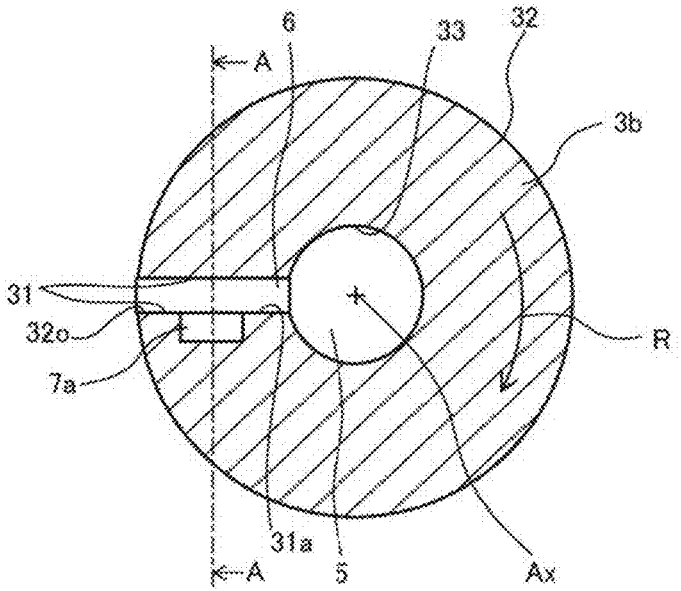
FIG. 9 is a cross-sectional view showing a modification of the shaft of the bearing structure according to Embodiment 2.
Figure 10:
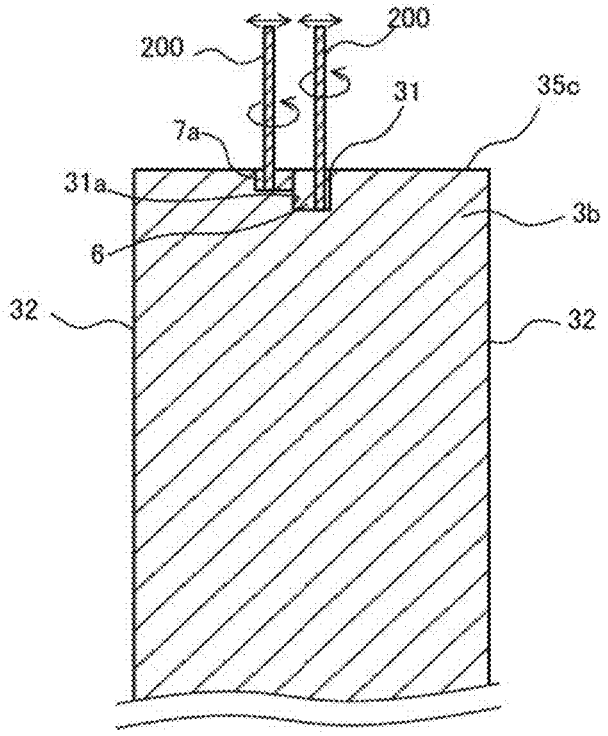
FIG. 10 is a longitudinal sectional view taken along line A-A in FIG. 9 and a diagram showing a method for machining a foreign matter separating space.

FIG. 9 is a cross-sectional view showing a modification of the shaft 3 of the bearing structure 1 according to Embodiment 2. FIG. 10 is a longitudinal sectional view taken along line A-A in FIG. 9 and a diagram showing a method for machining a foreign matter separating space 7*a*. While the shaft 3 is divided at a plane parallel to the axis Ax in the example configuration of FIGS. 6 to 8, the shaft 3 is divided at a plane perpendicular to the axis Ax in the modification shown in FIGS. 9 and 10.

As shown in FIG. 9, the shaft 3 includes a first element 3*a* (not illustrated) constituting one part, that is, an upper portion, of the shaft 3 in the axial direction and including upper portions of the branch oil feed hole 6 and the foreign matter separating space 7*a* and a second element 3*b* constituting the other part, that is, a lower portion, of the shaft 3 in the axial direction and including lower portions of the branch oil feed hole 6 and the foreign matter separating space 7*a*. The first element 3*a* and the second element 3*b* are assembled together, whereby the branch oil feed hole 6 and the foreign matter separating space 7*a* of the shaft 3 are formed. That is, in the modification of Embodiment 2, as shown in FIG. 9, the first element 3*a* (not illustrated) and the second element 3*b* each have a substantially columnar shape. Further, in the modification of Embodiment 2, as shown in FIG. 10, the branch oil feed hole 6 and the foreign matter separating space 7*a* are each quadrangular in cross-section.

Although not illustrated, the modification of Embodiment 2 is configured such that a lower end portion of the first element 3*a* and an upper end portion of the second element 3*b* fit each other, and a lower surface portion of the first element 3*a* and an upper surface portion 35*c* of the second element 3*b* face each other.

In the modification shown in FIGS. 9 and 10 of Embodiment 2, the shaft 3 is cut into the first element 3*a* and the second element 3*b* so that the branch oil feed hole 6 is divided into upper and lower parts at a plane perpendicular to the axis Ax; therefore, the foreign matter separating space 7*a* can be formed by milling. Specifically, the foreign matter separating space 7*a* can be formed by performing milling from the upper surface portion 35*c* in the second element 3*b* and performing milling from the lower surface portion in the first element 3*a*. Specifically, cutting is done with a rotary cutting tool 200 lowered to a predetermined position in the branch oil feed hole 6 in the upper surface portion 35*c* of the second element 3*b*. Further, the foreign matter separating space 7*a* is formed by performing milling perpendicularly in a transverse direction to the center line of the branch oil feed hole 6.

In a case in which the branch oil feed hole 6 and the foreign matter separating space 7*a* are each quadrangular in cross-section as shown in FIG. 10, milling may be performed only on the second element 3*b* so that upper walls of the branch oil feed hole 6 and the foreign matter separating space 7*a* are constituted by the lower surface portion of the first element 3*a*.

In the example shown in FIGS. 6 to 8 of Embodiment 2 and the modification shown in FIGS. 9 and 10, foreign matter 8 is separated from the lubricating oil in the branch oil feed hole 6 and trapped in the foreign matter separating space 7*a*; therefore, as in the case of Embodiment 1, an effect of making it possible to further reduce abrasion of sliding parts than has conventionally been the case is brought about.

Further, in the bearing structure 1 according to Embodiment 2, the rotor is constituted by a shaft 3, and the shaft 3 is constituted by a first element 3*a* including part of the branch oil feed hole 6 and a second element 3*b* including a remaining part of the branch oil feed hole 6.

This makes it possible to form the foreign matter separating space 7*a* by performing milling from a division surface (such as the first planar portion 35*a*) between the first element 3*a* and the second element 3*b*, thus eliminating the need for a special device such as a 3D printer and making it possible to avoid an increase in manufacturing cost.

Embodiment 3

Figure 11:
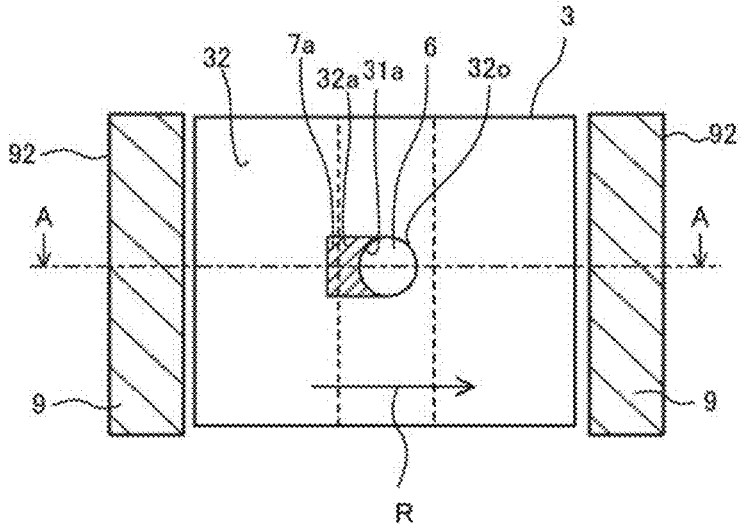
FIG. 11 is a longitudinal sectional view showing a configuration of a rotor of a bearing structure according to Embodiment 3.
Figure 12:
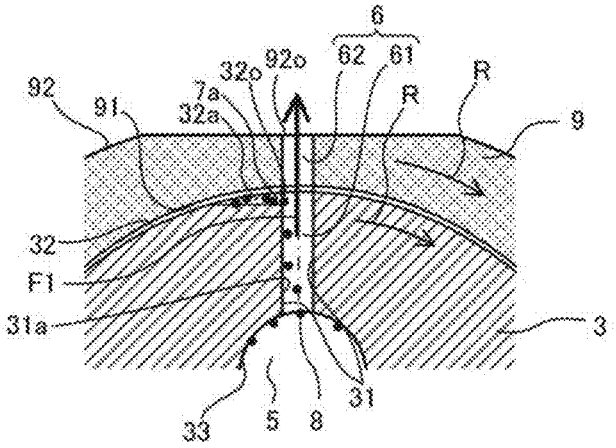
FIG. 12 is a partially cross-sectional view taken along line A-A in FIG. 11.

FIG. 11 is a longitudinal sectional view showing a configuration of a rotor of a bearing structure 1 according to Embodiment 3. FIG. 12 is a partially cross-sectional view taken along line A-A in FIG. 11. Embodiment 3 is different from Embodiment 1 in that the rotor is constituted by a shaft 3 and a cylindrically shaped sleeve 9 fitted onto an outer circumferential portion 32 of the shaft 3. In other respects, Embodiment 3 is identical to Embodiment 1. Components of Embodiment 3 that are identical to those of Embodiment 1 are given identical reference signs, and Embodiment 3 is described with a focus on differences from Embodiment 1. In the following, the bearing structure 1 of Embodiment 3 is described with reference to FIGS. 11 and 12.

The sleeve 9 is fixed to the shaft 3 and rotates at the same rotation speed as the shaft 3. That is, in Embodiment 3, the sleeve 9 is a mating element that slides over the slide bearing 2, and lubricating oil is supplied to a gap G (see FIG. 1) between the inner circumferential surface 21 of the slide bearing 2 and an outer circumferential portion 92 of the sleeve 9.

As shown in FIG. 12, the sleeve 9 is provided with a sleeve oil feed hole 62 bored therethrough in a radial direction, and the shaft 3 is provided with a shaft oil feed hole 61 bored therethrough in a radial direction. A branch oil feed hole 6 of the rotor is constituted by the sleeve oil feed hole 62 and the shaft oil feed hole 61. In a circumferential direction of the rotor, the sleeve oil feed hole 62 is provided in a location that is identical to that of the shaft oil feed hole 61, and the sleeve oil feed hole 62 and the shaft oil feed hole 61 are arranged in a straight line and communicate directly with each other. The sleeve oil feed hole 62 has an opening provided in the outer circumferential portion 92 of the sleeve 9, and the opening serves as an outlet 920 of the branch oil feed hole 6.

Note here that the statement that the sleeve oil feed hole 62 and the shaft oil feed hole 61 are arranged in a straight line means that as shown in FIG. 12, the center line of the shaft oil feed hole 61 (indicated by a dot-and-dash line in FIG. 12) and the center line of the sleeve oil feed hole 62 are arranged in a straight line. In the example shown in FIG. 12, the sleeve oil feed hole 62 and the shaft oil feed hole 61 are provided in a straight line, and the sleeve oil feed hole 62 has the same diameter as the diameter of the shaft oil feed hole 61, so that the inner wall 31 of the branch oil feed hole 6 at a boundary between the sleeve oil feed hole 62 and the shaft oil feed hole 61 is flat. It should be noted that the sleeve oil feed hole 62 and the shaft oil feed hole 61 may be different in diameter from each other.

Although, in FIGS. 11 and 12, the shaft 3 is constituted by one element, the shaft 3 may be constituted by a plurality of elements, such as those shown in Embodiment 2, that are assembled together to form a foreign matter separating space 7*a*.

A first outer circumferential recessed portion 32*a* formed by a recess in the outer circumferential portion 32 of the shaft 3 may be provided backward in the direction of rotation (direction of the arrow R) at an edge of the outlet 320 of the shaft oil feed hole 61. The foreign matter separating space 7*a* is formed by the first outer circumferential recessed portion 32*a* of the shaft 3 and an inner circumferential surface 91 of the sleeve 9. That is, in Embodiment 3 too, the foreign matter separating space 7*a* is provided in the inner wall portion 31*a* of the inner wall 31 of the branch oil feed hole 6 that is backward in the direction of rotation (direction of an arrow R) and upstream from the outlet 920.

The following describes an example of a method for manufacturing a bearing structure 1 of Embodiment 3. After the sleeve oil feed hole 62 has been formed in the sleeve 9 and the shaft oil feed hole 61 and the first outer circumferential recessed portion 32*a* have been formed in the shaft 3, the sleeve 9 is fitted and fixed onto the outer circumferential portion 32 of the shaft 3 so that the sleeve oil feed hole 62 and the shaft oil feed hole 61 face each other.

It should be noted that the timing of formation of the branch oil feed hole 6 is not limited to the aforementioned case. For example, after the sleeve oil feed hole 62 and the shaft oil feed hole 61 have been bored from the outer circumferential portion 92 of the sleeve 9 with the sleeve 9 fitted onto the outer circumferential portion 32 of the shaft 3, the sleeve 9 and the shaft 3 may be detached, and the first outer circumferential recessed portion 32*a* may be formed in the shaft 3.

As noted above, in the bearing structure 1 according to Embodiment 3 too, foreign matter 8 is separated from the lubricating oil in the branch oil feed hole 6 and trapped in the foreign matter separating space 7*a*; therefore, as in the case of Embodiment 1, an effect of making it possible to further reduce abrasion of sliding parts than has conventionally been the case is brought about.

Further, in Embodiment 3, the rotor is constituted by a cylindrically shaped shaft 3 and a cylindrically shaped sleeve 9 fitted onto an outer circumferential portion 32 of the shaft 3 and configured to rotate with the shaft 3. The branch oil feed hole 6 of the rotor incudes a shaft oil feed hole 61 provided in the shaft 3 and a sleeve oil feed hole 62 provided in the sleeve 9. A first outer circumferential recessed portion 32*a* formed by a recess in the outer circumferential portion 32 of the shaft 3 is provided backward in the direction of rotation (direction of the arrow R) at an opening edge (edge of the outlet 320) of the shaft oil feed hole 61. The foreign matter separating space 7*a* is formed by the first outer circumferential recessed portion 32*a* of the shaft 3 and an inner circumferential surface 91 of the sleeve 9.

According to this configuration, a bearing structure 1 having a foreign matter separating space 7*a* in the middle of a branch oil feed hole 6 can be manufactured by providing the first outer circumferential recessed portion 32*a* in the outer circumferential portion 32 of the shaft 3 with the shaft 3 and the sleeve 9 detached from each other and then assembling the shaft 3 and the sleeve 9 together. This makes it possible to easily manufacture the bearing structure 1 without using a special device such as a 3D printer.

Further, in a circumferential direction of the rotor, the sleeve oil feed hole 62 is provided in a location that is identical to that of the shaft oil feed hole 61, and the branch oil feed hole 6 of the rotor is constituted by the shaft oil feed hole 61 and the sleeve oil feed hole 62. This prevents the main flow of lubricating oil from being blocked in the branch oil feed hole 6, thus making it possible to smoothly supply the lubricating oil to the sliding parts while separating the foreign matter 8 into the foreign matter separating space 7*a*.

Embodiment 4

Figure 13:
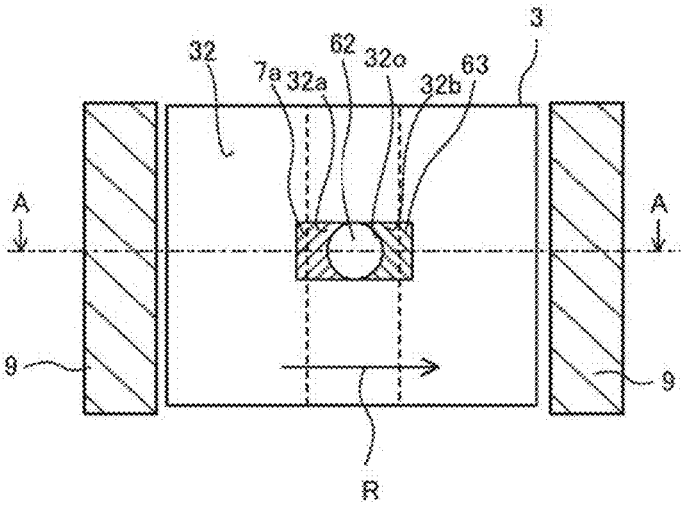
FIG. 13 is a longitudinal sectional view showing a configuration of a rotor of a bearing structure according to Embodiment 4.
Figure 14:
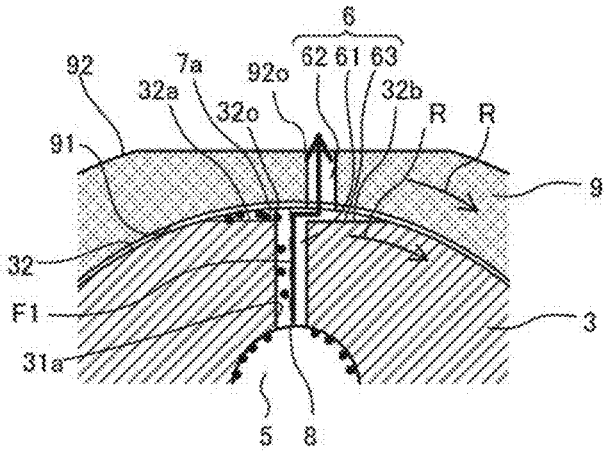
FIG. 14 is a partially cross-sectional view taken along line A-A in FIG. 13.

FIG. 13 is a longitudinal sectional view showing a configuration of a rotor of a bearing structure 1 according to Embodiment 4. FIG. 14 is a partially cross-sectional view taken along line A-A in FIG. 13.

In the bearing structure 1 of Embodiment 4 too, as in the case of Embodiment 3, the rotor is constituted by a shaft 3 and a sleeve 9 Note, however, that Embodiment 4 is different from Embodiment 3 in the shape of the branch oil feed hole 6 of the rotor. In the following, a configuration of the bearing structure 1 according to Embodiment 4 is described with reference to FIGS. 13 and 14.

In Embodiment 4, as shown in FIG. 14, in a circumferential direction of the rotor, the sleeve oil feed hole 62 is provided further forward in the direction of rotation (direction of the arrow R) than the shaft oil feed hole 61, and the sleeve oil feed hole 62 has an entrance provided further forward in the direction of rotation than the outlet 320 of the shaft oil feed hole 61. The rotor includes an oil feed space 63 through which the sleeve oil feed hole 62 and the shaft oil feed hole 61 communicate with each other, and the branch oil feed hole 6 is constituted by the shaft oil feed hole 61, the sleeve oil feed hole 62, and the oil feed space 63.

A second outer circumferential recessed portion 32*b* formed by a recess in the outer circumferential portion 32 of the shaft 3 is provided forward in the direction of rotation (direction of the arrow R) at the edge of the outlet 320 of the shaft oil feed hole 61. The oil feed space 63 is formed by the second outer circumferential recessed portion 32*b* of the shaft 3 and the inner circumferential surface 91 of the sleeve 9. That is, Embodiment 4 is configured such that the outer circumferential portion 32 of the shaft 3 has recesses both backward and forward in the direction of rotation (direction of the arrow R) at the edge of the outlet 320 of the shaft oil feed hole 61.

In the example shown in FIGS. 13 and 14, as shown in FIG. 13, the first outer circumferential recessed portion 32*a* and the second outer circumferential recessed portion 32*b* have widths that are equal to the width of the outlet 320 of the shaft oil feed hole 61 in the axial direction, and the first outer circumferential recessed portion 32*a* and the second outer circumferential recessed portion 32*b* form a horizontally long rectangular shape. Moreover, in the example shown in FIGS. 13 and 14, as shown in FIG. 14, the first outer circumferential recessed portion 32*a* and the second outer circumferential recessed portion 32*b* are shaped by cutting out the outer circumferential portion 32 of the shaft 3 in the same plane.

The following describes an example of a method for manufacturing a bearing structure 1 of Embodiment 4. The sleeve oil feed hole 62 is formed in the sleeve 9, and the shaft oil feed hole 61 is formed in the shaft 3. Further, the first outer circumferential recessed portion 32*a* and the second outer circumferential recessed portion 32*b* are formed by passing the cutting tool 200 in a transverse direction along a plane perpendicular to the center line of the shaft oil feed hole 61 while keeping the cutting tool 200 in contact with the outer circumferential portion 32 of the shaft 3. After that, the sleeve 9 is fitted and fixed onto the outer circumferential portion 32 of the shaft 3 so that the second outer circumferential recessed portion 32*b* of the shaft 3 and the sleeve oil feed hole 62 face each other.

As noted above, in the bearing structure 1 according to Embodiment 4 too, foreign matter 8 is separated from the lubricating oil in the branch oil feed hole 6 and trapped in the foreign matter separating space 7*a*; therefore, as in the case of Embodiment 1, an effect of making it possible to further reduce abrasion of sliding parts than has conventionally been the case is brought about.

Further, in Embodiment 4, in a circumferential direction of the rotor, the sleeve oil feed hole 62 is provided further forward in the direction of rotation (direction of the arrow R) than the shaft oil feed hole 61. A second outer circumferential recessed portion 32*b* formed by a recess in the outer circumferential portion 32 of the shaft 3 is provided forward in the direction of rotation at the opening edge (edge of the outlet 320) of the shaft oil feed hole 61, and an oil feed space 63 is formed by the second outer circumferential recessed portion 32*b* of the shaft 3 and the inner circumferential surface 91 of the sleeve 9. Moreover, the branch oil feed hole 6 of the rotor is constituted by the shaft oil feed hole 61, the sleeve oil feed hole 62, and the oil feed space 63.

This makes it possible to increase the capacity of a space in which to retain foreign matter 8 upstream from the outlet 920 in the branch oil feed hole 6 and makes it possible to accumulate more foreign matter 8 within the rotor, thus inhibiting foreign matter 8 from flowing outward from the outlet 920. Further, providing the sleeve oil feed hole 62 in a location that is further forward in the direction of rotation (direction of the arrow R) than the shaft oil feed hole 61 sets up a configuration in which the branch oil feed hole 6 is curved frontward in the direction of rotation upstream from the sleeve oil feed hole 62. This inhibits foreign matter 8 from reaching the sleeve oil feed hole 62 by being subjected to greater Coriolis force than the lubricating oil. A reason for this is that in the shaft 3 in rotation, a force in the direction of rotation that is greater than Coriolis force acting in a direction opposite to the direction of rotation does not act on foreign matter 8. Accordingly, in Embodiment 4, the amount of foreign matter 8 that is supplied to the gap G between the slide bearing 2 and the sleeve 9 can be further reduced than in the case of Embodiment 3, in which the branch oil feed hole 6 is provided in a straight line.

Embodiment 5

Figure 15:
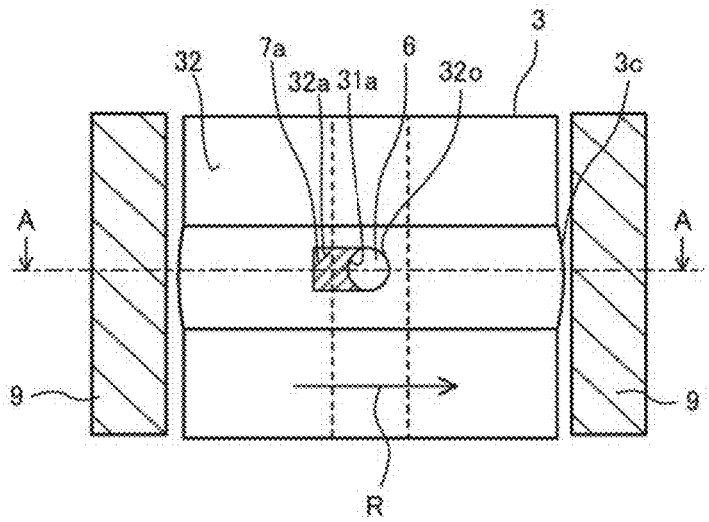
FIG. 15 is a longitudinal sectional view showing a configuration of a rotor of a bearing structure according to Embodiment 5.
Figure 16:
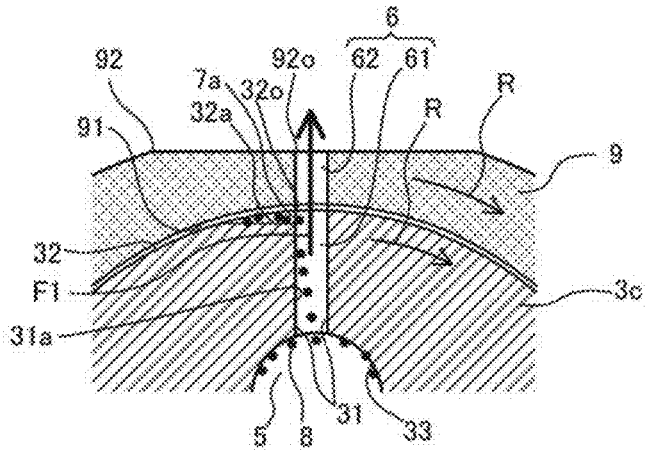
FIG. 16 is a partially cross-sectional view taken along line A-A in FIG. 15.

FIG. 15 is a longitudinal sectional view showing a configuration of a rotor of a bearing structure 1 according to Embodiment 5. FIG. 16 is a partially cross-sectional view taken along line A-A in FIG. 15.

In the bearing structure 1 of Embodiment 5 too, as in the case of Embodiment 3, the rotor is constituted by a shaft 3 and a sleeve 9 Note, however, that Embodiment 5 is different from Embodiment 3 in the shape of the shaft 3. In the following, a configuration of the bearing structure 1 according to Embodiment 5 is described with reference to FIGS. 15 and 16.

In Embodiment 5, the shaft 3 includes a crowning portion 3*c* in which the outer circumferential portion 32 is barreled. The crowning portion 3*c* is provided in part of the shaft 3 in the axial direction. The sleeve 9 is fitted and fixed onto the outer circumferential portion 32 of the shaft 3 to cover an outer circumferential portion of the crowning portion 3*c*, and the crowning portion 3*c* and the sleeve 9 rotate at the same rotation speed. The crowning portion 3*c* is provided so that the slide bearing 2 and the sleeve 9 maintain a parallel positional relationship with each other even in a case in which the shaft 3 becomes inclined.

The shaft oil feed hole 61 and the first outer circumferential recessed portion 32*a* are provided in the crowning portion 3*c* of the shaft 3, and the foreign matter separating space 7*a* is formed by the first outer circumferential recessed portion 32*a* provided in the crowning portion 3*c* and the inner circumferential surface 91 of the sleeve 9. Although FIG. 15 illustrates a case in which the crowning portion 3*c* is applied to the configuration of Embodiment 3, the crowning portion 3*c* may be applied to the configuration of Embodiment 4. In a case in which the crowning portion 3*c* is applied to the configuration of Embodiment 4, the crowning portion 3*c* is provided with the shaft oil feed hole 61, the first outer circumferential recessed portion 32*a*, and the second outer circumferential recessed portion 32*b*.

As noted above, in the bearing structure 1 according to Embodiment 5 too, foreign matter 8 is separated from the lubricating oil in the branch oil feed hole 6 and trapped in the foreign matter separating space 7*a*; therefore, as in the case of Embodiment 1, an effect of making it possible to further reduce abrasion of sliding parts than has conventionally been the case is brought about.

Further, in Embodiment 5, a crowning portion 3*c* in which the outer circumferential portion 32 of the shaft 3 is barreled is provided in part of the shaft 3 in the axial direction, and the shaft oil feed hole 61 and the first outer circumferential recessed portion 32*a* are provided in the crowning portion 3*c* of the shaft 3. Moreover, the sleeve 9 is fitted on the outer circumferential portion 32 of the shaft 3 to cover an outer circumference of the crowning portion 3*c*. This makes it possible to, even in a case in which the shaft 3 is provided with the crowning portion 3*c*, apply a configuration in which foreign matter 8 is separated, increasing versatility.

Embodiment 6

Figure 17:
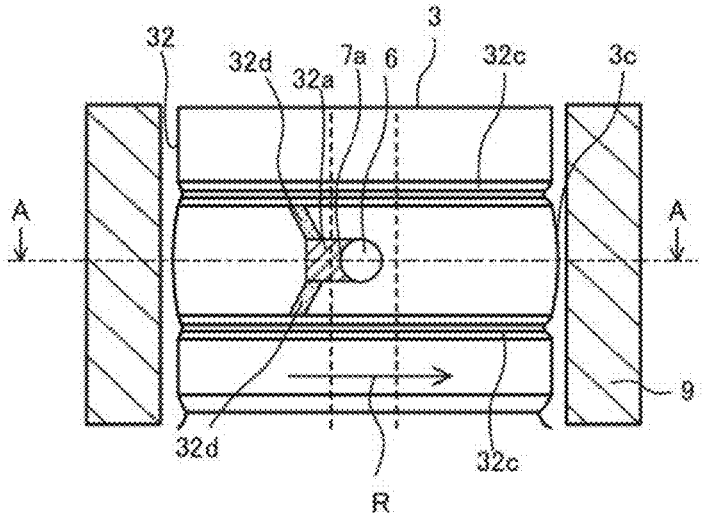
FIG. 17 is a longitudinal sectional view showing a configuration of a rotor of a bearing structure according to Embodiment 6.
Figure 18:
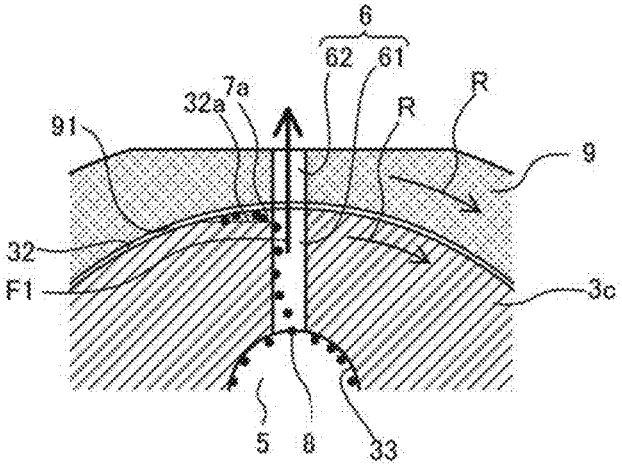
FIG. 18 is a partially cross-sectional view taken along line A-A in FIG. 17.

FIG. 17 is a longitudinal sectional view showing a configuration of a rotor of a bearing structure 1 according to Embodiment 6. FIG. 18 is a partially cross-sectional view taken along line A-A in FIG. 17.

As in the case of Embodiment 5, the bearing structure 1 according to Embodiment 6 too is configured such that the shaft 3 is provided with a crowning portion 3*c*, that the sleeve 9 is provided to cover an outer circumferential portion of the crowning portion 3*c*, and that the first outer circumferential recessed portion 32*a* is provided in the outer circumferential portion of the crowning portion 3*c*. Note, however, that Embodiment 6 is different from Embodiment 5 in that foreign matter storage grooves 32*c* and foreign matter drain grooves 32*d* are provided in the outer circumferential portion 32 of the shaft 3. In the following, a configuration of the bearing structure 1 according to Embodiment 6 is described with reference to FIGS. 17 and 18.

The first outer circumferential recessed portion 32*a*, the foreign matter storage grooves 32*c*, and the foreign matter drain grooves 32*d* are formed in a portion of the outer circumferential portion 32 of the shaft 3 covered with the sleeve 9. The foreign matter storage grooves 32*c* are circumferentially provided in locations away from the first outer circumferential recessed portion 32*a* in the axial direction. The foreign matter drain grooves 32*d* cause the first outer circumferential recessed portion 32*a* and the foreign matter storage grooves 32*c* to communicate with each other. Foreign matter 8 trapped in the foreign matter separating space 7*a* flows into the foreign matter storage grooves 32*c* via the foreign matter storage grooves 32*c* and is collected by the foreign matter storage grooves 32*c*.

In the example shown in FIG. 17, the foreign matter storage grooves 32*c* are provided at ends of the crowning portion 3*c* in the axial direction. Specifically, one of the foreign matter storage grooves 32*c* is provided at a boundary between a portion of the outer circumferential portion 32 of the shaft 3 that is higher than the crowning portion 3*c* and the crowning portion 3*c*, and the other of the foreign matter storage grooves 32*c* is provided at a boundary between a portion of the outer circumferential portion 32 of the shaft 3 that is lower than the crowning portion 3*c* and the crowning portion 3*c*. In the example shown in FIG. 17, the two foreign matter storage grooves 32*c* are each provided at a distance from the foreign matter separating space 7*a*, with one of the foreign matter drain grooves 32*d* provided to extend from an upper end of the first outer circumferential recessed portion 32*a* toward the upper foreign matter storage groove 32*c* and the other of the foreign matter drain grooves 32*d* provided to extend from a lower end of the first outer circumferential recessed portion 32*a* toward the lower foreign matter storage groove 32*c*.

The shapes of the foreign matter drain grooves 32*d* are determined with reference to the orientation of Coriolis force acting on the foreign matter 8. In the example shown in FIG. 17, the foreign matter drain grooves 32*d*, which extend from the first outer circumferential recessed portion 32*a*, are inclined in a direction opposite to the direction of rotation (direction of the arrow R) of the shaft 3. That is, each of the foreign matter drain grooves 32*d* is provided at an angle backward in a direction opposite to the direction of rotation, that is, backward in the direction of rotation, as it extends from the first outer circumferential recessed portion 32*a* toward the corresponding one of the foreign matter storage grooves 32*c*. The foreign matter drain grooves 32*d* thus provided inhibit the foreign matter 8 from flowing backward from the foreign matter storage grooves 32*c* into the foreign matter separating space 7*a*.

In Embodiment 6 too, as in the case of Embodiment 5, the shaft oil feed hole 61 is provided in the crowning portion 3*c* of the shaft 3. In the example shown in FIG. 18, as in the case of Embodiment 3, the sleeve oil feed hole 62 and the shaft oil feed hole 61 are provided in a straight line and communicate directly with each other. It should be noted that as shown in Embodiment 4, in a circumferential direction, the sleeve oil feed hole 62 may be provided further forward in the direction of rotation of the shaft 3 than the shaft oil feed hole 61, and the sleeve oil feed hole 62 and the shaft oil feed hole 61 may communicate with each other via the oil feed space 63.

The foreign matter 8 trapped in the foreign matter separating space 7*a* by separating from the lubricating oil due to the action of Coriolis force is further collected by flowing from the foreign matter separating space 7*a* into foreign matter storage grooves 32*c* through the foreign matter drain grooves 32*d* due to the action of Coriolis force. In the case of Embodiment 6, the foreign matter 8 does not flow backward from the foreign matter storage grooves 32*c* into the foreign matter separating space 7*a* as long as the shaft 3 does not rotate in the opposite direction, as the foreign matter drain grooves 32*d* are provided.

As noted above, in the bearing structure 1 according to Embodiment 6 too, foreign matter 8 is separated from the lubricating oil in the branch oil feed hole 6 and trapped in the foreign matter separating space 7*a*; therefore, as in the case of Embodiment 1, an effect of making it possible to further reduce abrasion of sliding parts than has conventionally been the case is brought about.

Further, in Embodiment 6, foreign matter storage grooves 32*c* provided away from the first outer circumferential recessed portion 32*a* in the axial direction and foreign matter drain grooves 32*d* through which the first outer circumferential recessed portion 32*a* and the foreign matter storage grooves 32*c* communicate with each other are formed in a portion of the outer circumferential portion 32 of the shaft 3 covered with the sleeve 9.

According to this configuration, foreign matter 8 trapped in the foreign matter separating space 7*a* is collected in the foreign matter storage grooves 32*c*, whereby more foreign matter 8 can be retained within the rotor. This makes it possible to reduce the amount of foreign matter 8 that is supplied to the gap G between the slide bearing 2 and the sleeve 9. Furthermore, the foreign matter 8 thus collected can be retained in flow passages that are deeper than the outlet 920, that is, the foreign matter storage grooves 32*c*. This inhibits foreign matter 8 once trapped in the foreign matter separating space 7*a* from flowing again into the branch oil feed hole 6, making it possible to more surely reduce the amount of foreign matter 8 that is supplied to the gap G.

Further, a crowning portion 3*c* in which the outer circumferential portion 32 of the shaft 3 is barreled is provided in part of the shaft 3 in the axial direction, and the shaft oil feed hole 61 and the first outer circumferential recessed portion 32*a* are provided in the crowning portion 3*c* of the shaft 3. The sleeve 9 is fitted on the outer circumferential portion 32 of the shaft 3 to cover an outer circumference of the crowning portion 3*c*, and the foreign matter storage grooves 32*c* are provided at ends of the crowning portion 3*c* in the axial direction.

According to this configuration, the shape of the crowning portion 3*c* can be utilized to provide recesses such as the first outer circumferential recessed portion 32 and the foreign matter drain grooves 32*d* in the barreled outer circumferential portion of the barreled crowning portion 3*c* and provide the foreign matter storage grooves 32*c* at constricted ends of the crowning portion 3*c*. This makes it possible to easily form a structure in which foreign matter 8 is retained between the crowning portion 3*c* and the sleeve 9.

Figure 19:
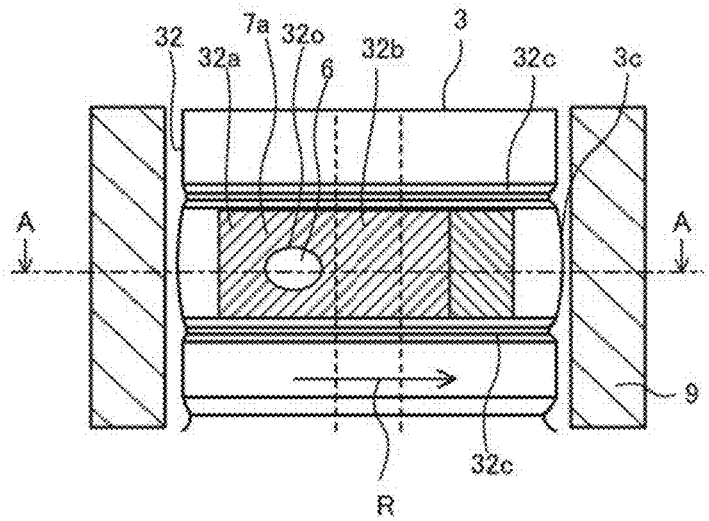
FIG. 19 is a longitudinal sectional view showing a first modification of the rotor of the bearing structure according to Embodiment 6.
Figure 20:
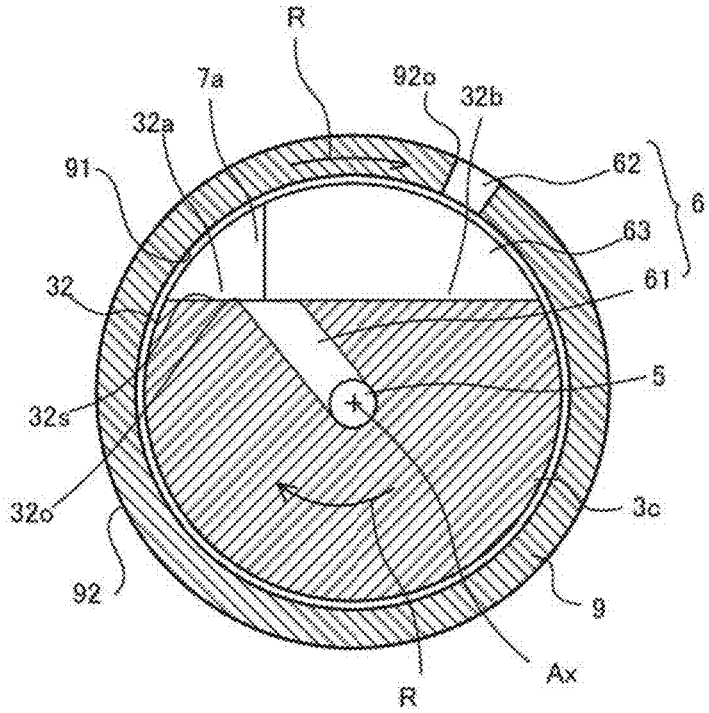
FIG. 20 is a partially cross-sectional view taken along line A-A in FIG. 19.

FIG. 19 is a longitudinal sectional view showing a first modification of the rotor of the bearing structure 1 according to Embodiment 6. FIG. 20 is a partially cross-sectional view taken along line A-A in FIG. 19. The first modification of Embodiment 6 is described with reference to FIGS. 19 and 20.

As shown in FIG. 20, in the first modification of Embodiment 6, as in the case of Embodiment 4, in a circumferential direction of the rotor, the sleeve oil feed hole 62 is provided further forward in the direction of rotation of the shaft 3 than the shaft oil feed hole 61. The first outer circumferential recessed portion 32*a* and the second outer circumferential recessed portion 32*b* are provided in continuity in the outer circumferential portion of the crowning portion 3*c*, and the sleeve oil feed hole 62 and the shaft oil feed hole 61 communicate with each other through an oil feed space 63 formed by the first outer circumferential recessed portion 32*a* and the inner circumferential surface 91 of the sleeve 9. Further, in the modification of Embodiment 6, the shaft oil feed hole 61 is provided at an angle with respect to side surfaces 32*s* of the first outer circumferential recessed portion 32*a* and the second outer circumferential recessed portion 32*b* formed in a plane parallel to the axis Ax. Specifically, the shaft oil feed hole 61 is inclined backward in the direction of rotation (direction of the arrow R) so that the outlet 320 of the shaft oil feed hole 61 is away from the entrance of the sleeve oil feed hole 62.

As shown in FIG. 19, foreign matter storage grooves 32*c* are provided at a distance from the edge of the outlet 320 of the shaft oil feed hole 61 and at both ends of the edge in the axial direction. In the modification of Embodiment 6, the first outer circumferential recessed portion 32*a* and the second outer circumferential recessed portion 32*b* are provided astride the upper and lower foreign matter storage grooves 32*c* to include the entire edge of the outlet 320 of the shaft oil feed hole 61. That is, the foreign matter separating space 7*a* is connected directly to the foreign matter storage grooves 32*c*, and no foreign matter drain grooves 32*d* are provided.

As a method for forming the foreign matter separating space 7*a* and the oil feed space 63 in continuity in the shaft 3 of the first modification of Embodiment 6, there is for example a method for removing part of the outer circumferential portion of the crowning portion 3*c* in a circumferential direction by milling as in the case of Embodiment 4.

As noted above, in the first modification of Embodiment 6, in a portion of the outer circumferential portion 32 of the shaft 3 covered with the sleeve 9, foreign matter storage grooves 32*c* are provided at a distance from the opening edge (edge of the outlet 320) of the shaft oil feed hole 61 and at both ends of the opening edge in the axial direction. The first outer circumferential recessed portion 32*a* is provided astride two of these foreign matter storage grooves 32*c* in the axial direction. This makes it unnecessary to provide foreign matter drain grooves 32*d*, thus simplifying the manufacturing process.

Further, in the first modification of Embodiment 6, in a portion of the outer circumferential portion 32 of the shaft 3 covered with the sleeve 9, foreign matter storage grooves 32*c* are provided at a distance from the opening edge (edge of the outlet 320) of the shaft oil feed hole 61 and at both ends of the opening edge in the axial direction. The first outer circumferential recessed portion 32*a* and the second outer circumferential recessed portion 32*b* are provided in continuity and provided astride two of these foreign matter storage grooves 32*c* in the axial direction. Moreover, the shaft oil feed hole 61 intersects at an angle with side surfaces 32*s* of the first outer circumferential recessed portion 32*a* and the second outer circumferential recessed portion 32*b* and is inclined backward in the direction of rotation.

This causes lubricating oil containing foreign matter 8 to be released into a space away from the sleeve oil feed hole 62, thus inhibiting the foreign matter 8 from reaching the sleeve oil feed hole 62 by being subjected to greater Coriolis force than the lubricating oil. This results in making it possible to further reduce the amount of foreign matter 8 that is supplied to the gap G.

Figure 21:
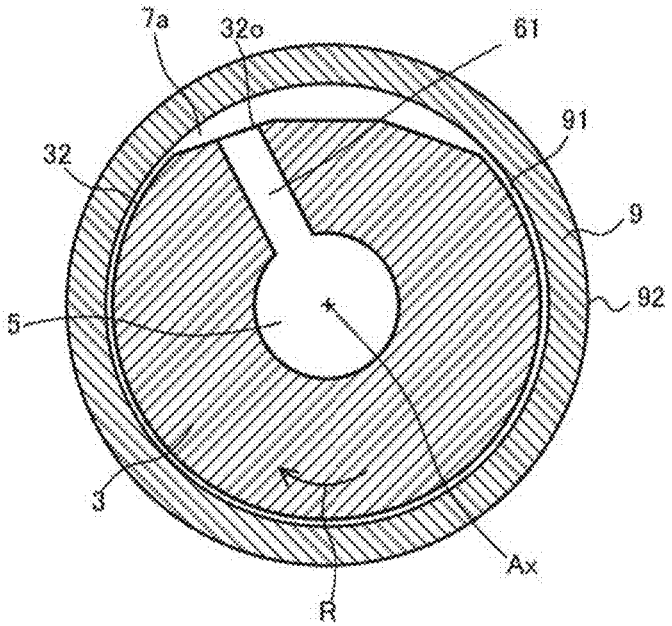
FIG. 21 is a cross-sectional view showing a second modification of the rotor of the bearing structure according to Embodiment 6.

FIG. 21 is a cross-sectional view showing a second modification of the rotor of the bearing structure 1 according to Embodiment 6. As shown in FIG. 21, in the second embodiment, the contours of the outer circumferential portion 32 of the shaft 3 are in the shape of a combination of an arc and a plurality of straight lines. Alternatively, the contours of the outer circumferential portion 32 of the shaft 3 may be in a polygonal shape composed of a plurality of straight lines or a multi-arc shape composed of a plurality of arcs. In the second embodiment, the foreign matter separating space 7*a* is formed by the outer circumferential portion 32 of the shaft 3 and the inner circumferential portion of the sleeve 9. This makes it possible to trap foreign matter 8 contained in lubricating oil flowing out from the shaft oil feed hole 61. This results in making it possible to reduce the amount of foreign matter 8 that is supplied to the gap G.

Figure 22:
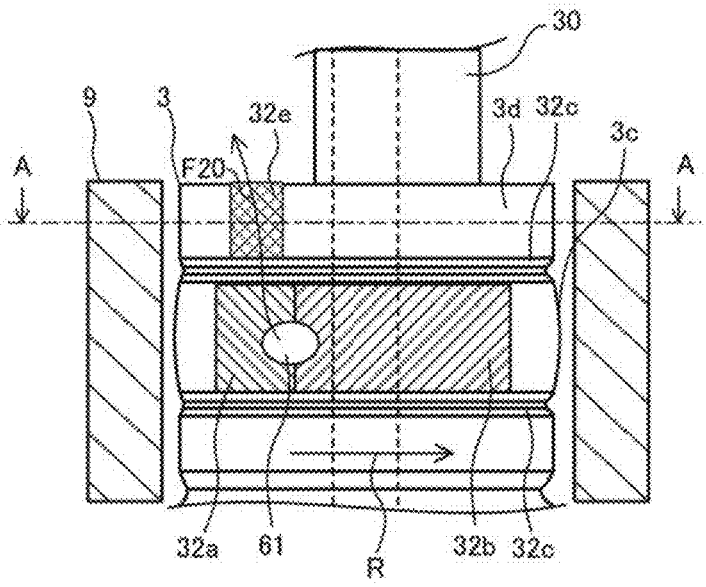
FIG. 22 is a longitudinal sectional view showing a third modification of the rotor of the bearing structure according to Embodiment 6.
Figure 23:
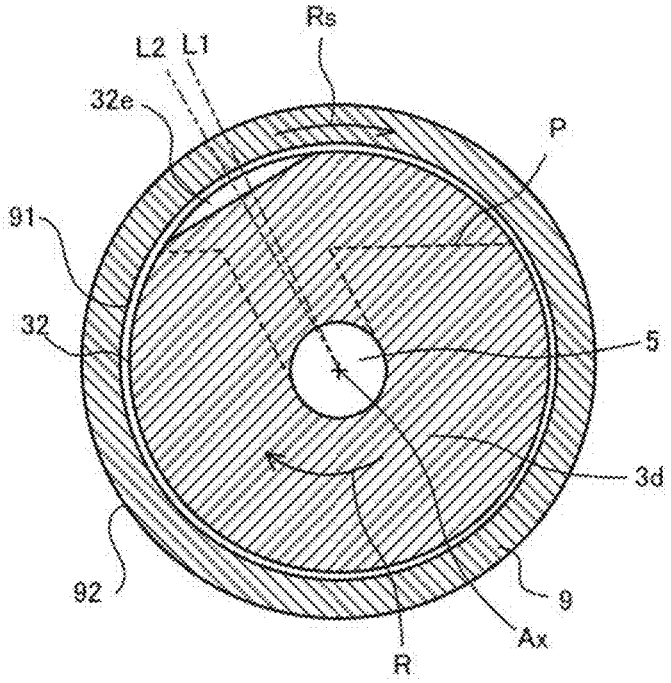
FIG. 23 is a partially cross-sectional view taken along line A-A in FIG. 22.

FIG. 22 is a longitudinal sectional view showing a third modification of the rotor of the bearing structure 1 according to Embodiment 6. FIG. 23 is a partially cross-sectional view taken along line A-A in FIG. 22. In FIG. 23, the dashed lines P indicate the positions of projection of the shaft oil feed hole 61 and the side surfaces 32*s* of the first outer circumferential recessed portion 32*a* and the second outer circumferential recessed portion 32*b*, which are shown in FIG. 20.

As shown in FIG. 22, in the third modification, the shaft 3 has cylindrical portions 3*d* provided above and below the barreled crowning portion 3*c* via the foreign matter storage grooves 32*c*. Further, the shaft 3 has an eccentric portion 30 provided further above the upper cylindrical portion 3*d* and placed eccentrically with respect to the cylindrical portion 3*d*. The crowning portion 3*c* of the shaft 3 in the axial direction and the foreign matter storage grooves 32*c* and the cylindrical portions 3*d* provided at the top and bottom of the crowning portion 3*c* are covered with the sleeve 9, and the eccentric portion 30 is exposed from the sleeve 9.

In the third modification, as shown in FIGS. 22 and 23, a foreign matter drain space 32*e* is provided between the outer circumferential portion 32 of the cylindrical portion 3*d* of the shaft 3 and the inner circumferential surface 91 of the sleeve 9 by providing a notch in the outer circumferential portion 32. As shown in FIG. 22, the foreign matter drain space 32*e* is provided in the outer circumferential portion 32 of the upper cylindrical portion 3*d* to extend from an upper end of the cylindrical portion 3*d* to a lower end in the axial direction and causes the foreign matter storage grooves 32*c* to communicate with a space above the cylindrical portion 3*d*. Foreign matter 8 leaving the shaft oil feed hole 61 is drained out of the shaft 3 through the first outer circumferential recessed portion 32*a*, the foreign matter storage grooves 32*c*, and the foreign matter drain space 32*e* while moving backward in the direction of rotation with respect to the shaft 3, which rotates in the direction of rotation (direction of the arrow R), in a trajectory indicated by an arrow F20 in FIG. 22.

Although not illustrated, a foreign matter drain space 32*e* may be provided in the lower cylindrical portion 3*d* as well as the cylindrical portion 3*d* above the shaft oil feed hole 61. Although, in FIG. 22, the foreign matter drain space 32*e* is provided only in a portion of the outer circumferential portion 32 of the shaft 3 covered with the sleeve 9, the foreign matter drain space 32*e* may be extended to a portion of the outer circumferential portion 32 of the shaft 3 exposed from the sleeve 9.

Further, the shapes of the foreign matter drain grooves 32*d* of FIG. 17, the foreign matter drain space 32*e* may have a shape inclined in a direction in which foreign matter is actively drained from the foreign matter separating space 7*a* when the shaft 3 rotates. That is, the foreign matter drain space 32*e* may be provided at an angle in a direction opposite to the direction of rotation (direction of the arrow R), that is, backward in the direction of rotation, as it extends from an entrance beside the foreign matter storage groove 32*c* toward an exit in the axial direction.

Furthermore, as shown in FIGS. 22 and 23, the foreign matter drain space 32*e* may be provided at an angle further backward in the direction of rotation than the position of projection of the shaft oil feed hole 61. That is, as shown in FIG. 23, the foreign matter drain space 32*e* may be provided so that the center axis line L2 of the foreign matter drain space 32*e* is further backward in the direction of rotation (direction of the arrow R) than the center axis line L1 of the shaft oil feed hole 61 projected (see the dashed lines P). Note here that the center axis line L2 of the foreign matter drain space 32*e* is a straight line passing through the center of the foreign matter drain space 32*e* in a circumferential direction of the shaft 3 and the axis Ax of the shaft 3. In FIG. 23, the position of projection of the shaft oil feed hole 61 is illustrated using the dashed lines P; however, as shown in FIG. 22, the position in which the foreign matter drain space 32*e* is provided in the axial direction is different from the position in which the shaft oil feed hole 61 is provided.

As noted above, in the third modification shown in FIGS. 22 and 23, in the portion of the outer circumferential portion 32 of the shaft 3 covered with the sleeve 9, the foreign matter storage grooves 32*c* and a foreign matter drain space 32*e* through which the foreign matter storage grooves 32*c* and an outside of the portion of the outer circumferential portion 32 of the shaft 3 covered with the sleeve 9 communicate with each other are formed. This causes foreign matter trapped in the foreign matter separating space 7*a* and the oil feed space 63 to be drained out of the bearing structure through the foreign matter drain space 32*e*. This results in making it possible to further reduce the amount of foreign matter 8 that is supplied to the gap G.

Figure 24:
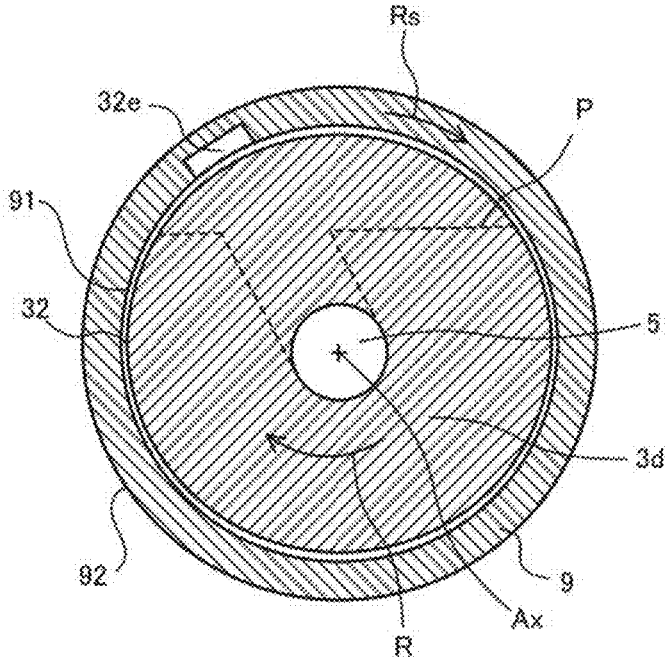
FIG. 24 is a cross-sectional view showing a fourth modification of the rotor of the bearing structure according to Embodiment 6.

FIG. 24 is a cross-sectional view showing a fourth modification of the rotor of the bearing structure according to Embodiment 6. As shown in FIG. 24, a foreign matter drain space 32*e* may be provided as a key groove in the inner circumferential surface 91 of the sleeve 9. The foreign matter drain space 32*e* makes it possible to actively drain lubricating oil containing a high proportion of foreign matter 8 retained in the foreign matter separating space 7*a*.

Figure 25:
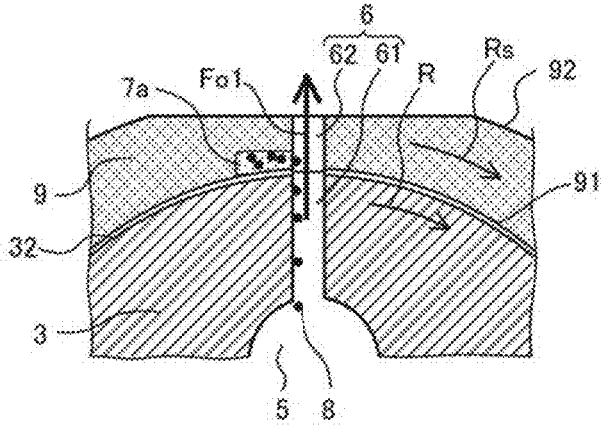
FIG. 25 is a cross-sectional view showing a fifth modification of the rotor of the bearing structure according to Embodiment 6.

FIG. 25 is a cross-sectional view showing a fifth modification of the rotor of the bearing structure according to Embodiment 6. As shown in FIG. 25, in the fifth modification of Embodiment 6, the foreign matter separating space 7*a* is provided in the inner circumferential surface 91 of the sleeve 9. In the fifth modification, the foreign matter separating space 7*a* is formed, for example, by wire electric discharge machining. In a case in which a groove is formed over the entire length of the inner circumferential surface 91 of the sleeve 9 in the axial direction by wire electric discharge machining, a foreign matter drain space 32*e* shown in the fourth modification (see FIG. 24) of Embodiment 6 too is formed at the same time. A method for forming the foreign matter separating space 7*a* is not limited to the aforementioned method, and the foreign matter separating space 7*a* may also be formed by machining a recess in the inner circumferential surface 91 of the sleeve 9 with an internal cylindrical grinding machine.

As noted above, in a case in which the foreign matter separating space 7*a* and the foreign matter drain space 32*e* are provided in the sleeve 9 too, foreign matter 8 trapped in the foreign matter separating space 7*a* is drained out of the bearing structure through the foreign matter drain space 32*e* as in the case in which the foreign matter separating space 7*a* and the foreign matter drain space 32*e* are provided in the shaft 3. This results in making it possible to further reduce the amount of foreign matter 8 that is supplied to the gap G.

Embodiment 7

Figure 26:
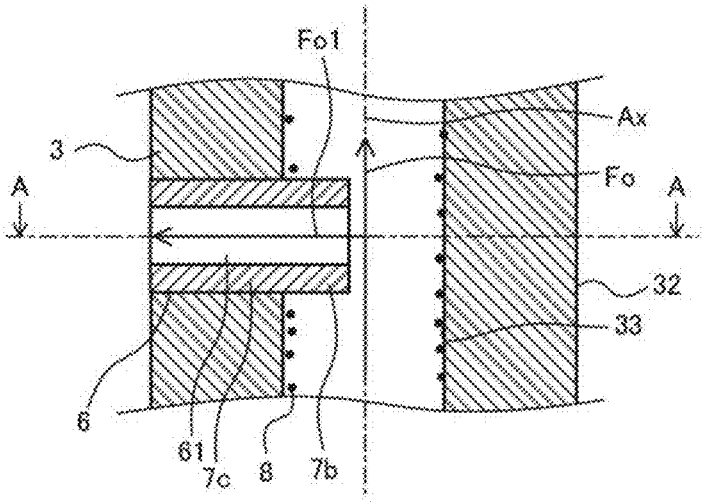
FIG. 26 is a longitudinal sectional view showing a modification of a shaft of a bearing structure according to Embodiment 7.
Figure 27:
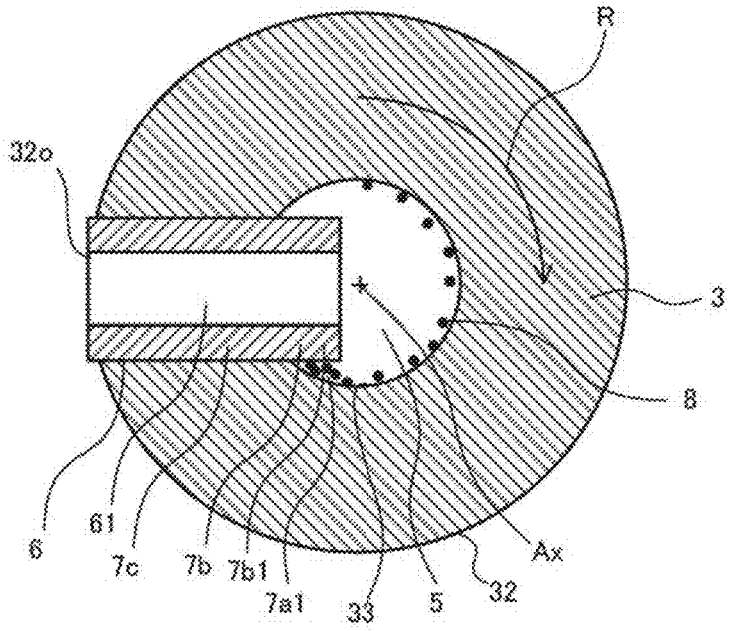
FIG. 27 is a partially cross-sectional view taken along line A-A in FIG. 26.

FIG. 26 is a longitudinal sectional view showing a modification of a shaft 3 of a bearing structure according to Embodiment 7. FIG. 27 is a partially cross-sectional view taken along line A-A in FIG. 26. In Embodiment 7, the foreign matter separation portion is constituted by a foreign matter separating wall 7*b* provided at an entrance of the branch oil feed hole 6 and extended from the entrance of the branch oil feed hole 6 into the main oil feed hole 5. As shown in FIGS. 26 and 27, the foreign matter separating wall 7*b* is provided close to the center of the main oil feed hole 5. That is, the entrance of the branch oil feed hole 6 is provided closer to the center of the main oil feed hole 5 than an inner wall surface of the main oil feed hole 5 (inner circumferential surface 33 of the shaft 3). As a method for forming the foreign matter separating wall 7*b* at the entrance of the branch oil feed hole 6, there is for example a method for inserting a cylindrical foreign matter separating wall forming element 7*c* into the branch oil feed hole 6. In the foreign matter separating wall forming element 7*c* inserted into the branch oil feed hole 6, an end beside the axis Ax that protrudes into the main oil feed hole 5 is the foreign matter separating wall 7*b*.

As shown in FIG. 27, a space 7*a*1 is formed between a wall portion 7*b*1 of the foreign matter separating wall 7*b* that is backward in the direction of rotation (direction of the arrow R) and the inner wall surface of the main oil feed hole 5. That is, the space 7*a*1 is formed further backward in the direction of rotation (direction of the arrow R) than the entrance of the branch oil feed hole 6 by the foreign matter separating wall 7*b* being extended from the entrance of the branch oil feed hole 6 into the main oil feed hole 5.

While the shaft 3 is rotating, the lubricating oil is suctioned upward in an oil feed direction (direction of an arrow Fo) from a lower end of the shaft 3 into the main oil feed hole 5. The lubricating oil in the main oil feed hole 5 moves upward while generating a swirl flow in the same direction as the direction of rotation (direction of the arrow R) of the shaft 3. Foreign matter 8 present in lubricating oil forming a swirl flow swirls with the lubricating oil. Due to the action of centrifugal force on the foreign matter 8, the foreign matter 8 flows in the same direction as the direction of rotation (direction of the arrow R) of the shaft 3 along the inner circumferential surface 33 of the shaft 3 in part of the main oil feed hole 5 that is far away from the axis Ax. Foreign matter 8 swirling along the inner wall surface (inner circumferential surface 33) of the main oil feed hole 5 is blocked by the wall portion 7*b*1 of the foreign matter separating wall 7*b* from moving forward in the direction of rotation and trapped in the space 7*a*1 that is further backward in the direction of rotation than the entrance of the branch oil feed hole 6.

As noted above, in the bearing structure 1 according to Embodiment 7 too, a foreign matter separating portion in which foreign matter 8 is separated from the lubricating oil is provided further backward in the direction of rotation than the branch oil feed hole 6; therefore, as in the case of Embodiment 1, an effect of reducing abrasion of sliding parts by the foreign matter 8 is brought about.

Further, the bearing structure 1 according to Embodiment 7 includes a foreign matter separating wall 7*b* extending from an entrance of the branch oil feed hole 6 into the main oil feed hole 5, and a space 7*a*1 formed further backward in the direction of rotation that the entrance of the branch oil feed hole 6 by the foreign matter separating wall 7*b* functions as a foreign matter separating portion. This makes it possible to separate foreign matter 8 from lubricating oil and trap the foreign matter 8 upstream of the entrance of the branch oil feed hole 6 in the direction in which the lubricating oil and the foreign matter 8 flow, making it possible to inhibit the foreign matter 8 from being suctioned through the entrance of the branch oil feed hole 6.

Embodiment 8

Figure 28:
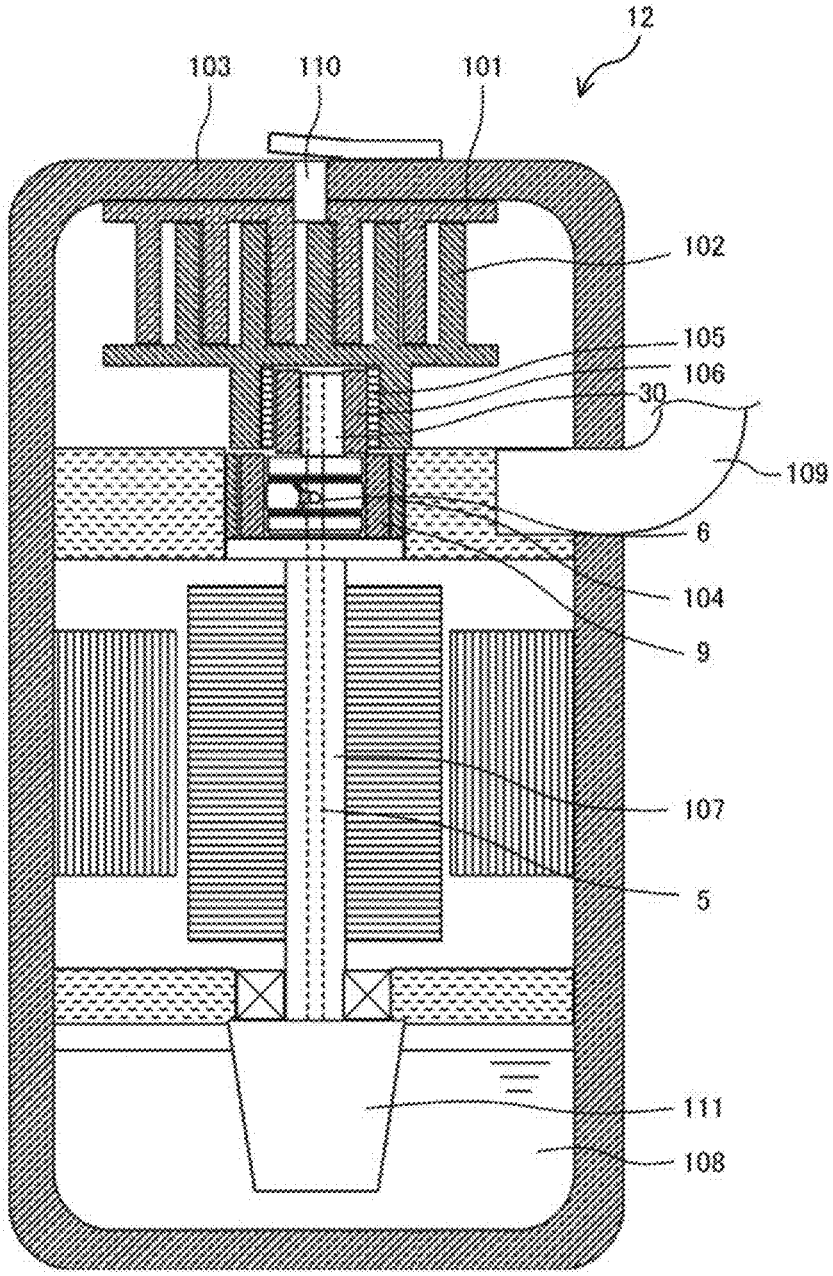
FIG. 28 is a longitudinal sectional view showing a configuration of a compressor according to Embodiment 8.

FIG. 28 is a longitudinal sectional view showing a configuration of a compressor 12 according to Embodiment 8. Embodiment 8 illustrates a case in which Embodiment 6, which is shown in FIGS. 17 and 18, is applied to the compressor 12. The compressor 12 is a closed compressor that is used in air-conditioning cooling equipment such as an air conditioner and a refrigerating machine. The following describes a configuration of the compressor 12 with reference to FIG. 28 on the assumption that the compressor 12 is a scroll compressor. It should be noted that the present disclosure can also be applied to another compressor such as a rotary compressor. Components of Embodiment 8 that are identical to those of Embodiment 1 are given identical reference signs, and Embodiment 3 is described with a focus on differences from Embodiment 1.

The compressor 12 includes a closed vessel 103 constituting an outer shell, a fixed scroll 101, an orbiting scroll 102, and a crank shaft 107 having an eccentric portion 30. The closed vessel 103 is provided with a suction port 109 through which refrigerant is suctioned and a discharge port 110 through which compressed refrigerant is discharged. The crank shaft 107 is equivalent to the aforementioned shaft 3. The crank shaft 107 is configured to transmit, to the orbiting scroll 102, motive power that compresses refrigerant. The fixed scroll 101 and the orbiting scroll 102 each have a spiral tooth shape.

Further, the compressor 12 includes a cylindrically shaped slider 106 and a cylindrically shaped sleeve 9. The slider 106 is fitted on the eccentric portion 30 of the crank shaft 107. The sleeve 9 is fitted in such a place on the crank shaft 107 as to support reaction force that is generated when refrigerant is compressed by rotating the orbiting scroll 102. Further, the compressor 12 includes an orbiting bearing 105 fitted onto the slider 106, a main bearing 104 fitted onto the sleeve 9, a main oil feed hole 5 provided inside the crank shaft 107, and a branch oil feed hole 6 provided astride the crank shaft 107 and the sleeve 9. Further, an oil feed pump 111 is attached to a lower portion of the crank shaft 107. The oil feed pump 111 is caused by rotation of the crank shaft 107 to suck up lubricating oil from an oil sump 108 and send the lubricating oil to the main oil feed hole 5.

FIG. 28 illustrates a case in which the foreign matter separating space 7*a* of Embodiment 6 is provided in a place on the crank shaft 107 in which the sleeve 9 is fitted, and the rotor is constituted by the shaft 3 and the sleeve 9. It should be noted that the bearing structure 1 of any of Embodiments 1 to 7 may be applied to the compressor 12 of the present disclosure. In a case in which the bearing structure 1 of Embodiment 1, 2, or 7 is applied to the compressor 12 of the present disclosure, the compressor 12 is configured to include the shaft 3 of Embodiment 1 or 2 instead of the rotor of the present disclosure, that is, the shaft 3 and the sleeve 9.

As noted above, a compressor 12 according to Embodiment 8 includes the bearing structure 1 and a closed vessel 103 housing the bearing structure 1. This makes it possible to, even if foreign matter 8 present in the oil sump 108 is sent to the main oil feed hole 5 via the oil feed pump 111, inhibit the foreign matter 8 from being supplied to sliding parts of the main bearing 104 and the sleeve 9. This makes it possible to reduce abrasion of the sliding parts, lengthening the life of the compressor 12.

It should be noted that the present disclosure is not limited to being applied to the compressor 12 but may be applied to another rotary machine having a configuration in which lubricating oil is supplied to sliding parts of the rotor and the sliding bearing 2 via the rotor. Further, a refrigeration cycle apparatus 10 to which the compressor 12 of the present disclosure is applied is not limited to the aforementioned air-conditioning cooling equipment.

Figure 29:
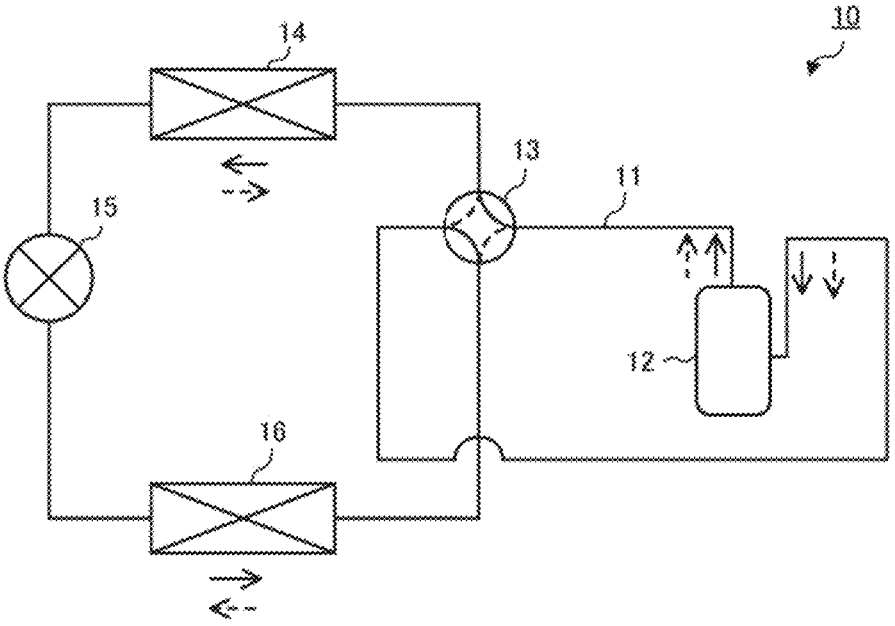
FIG. 29 is a circuit diagram showing a refrigerant circuit of a refrigeration cycle apparatus including the compressor according to Embodiment 8.

FIG. 29 is a circuit diagram showing a refrigerant circuit 11 of a refrigeration cycle apparatus 10 including the compressor 12 according to Embodiment 8. The refrigeration cycle apparatus 10 includes a refrigerant circuit 11 through which refrigerant circulates. The following description assumes that the refrigeration cycle apparatus 10 is an air conditioner.

The refrigerant circuit 11 is formed by the compressor 12, an outdoor heat exchanger 14, a pressure reducing device 15, an indoor heat exchanger 16, or other devices being connected by refrigerant pipes. The compressor 12 is configured to compress refrigerant and cause the refrigerant to circulate through the refrigerant circuit 11. The outdoor heat exchanger 14 and the indoor heat exchanger 16 are configured to cause the refrigerant and air to exchange heat with each other. The pressure reducing device 15 is constituted, for example, by an expansion valve and configured to expand and decompress the refrigerant. Further, in the example shown in FIG. 29, the refrigerant circuit 11 includes a flow switching device 13. The flow switching device 13 is constituted, for example, by a four-way valve and configured to switch among flow passages of refrigerant discharged from the compressor 12.

The flow switching device 13 enables switching between cooling and heating. The refrigeration cycle apparatus 10 includes a controller (not illustrated) configured to control various actuators. The controller controls, for example, the frequency of the compressor 12, the opening degree of the pressure reducing device 15, and the switching of the flow switching device 13. During cooling operation, as indicated by solid arrows in FIG. 29, the refrigerant discharged from the compressor 12 returns to the compressor 12 after flowing the outdoor heat exchanger 14, the pressure reducing device 15, and the indoor heat exchanger 16 in sequence. Meanwhile, during heating operation, as indicated by dashed arrows in FIG. 29, the refrigerant discharged from the compressor 12 returns to the compressor 12 after flowing the indoor heat exchanger 16, the pressure reducing device 15, and the outdoor heat exchanger 14 in sequence. That is, during indoor cooling, the outdoor heat exchanger 14 functions as a condenser, and the indoor heat exchanger 16 functions and an evaporator. During indoor heating, the indoor heat exchanger 16 functions as a condenser, and the outdoor heat exchanger 14 functions and an evaporator. Therefore, during heating, the indoor heat exchanger 16 heats indoor air by causing the refrigerant compressed by the compressor 12 to reject heat, and during cooling, the indoor heat exchanger 16 cools indoor air by causing the refrigerant expanded by the pressure reducing device 15 to remove heat.

It should be noted that the configuration of the refrigerant circuit 11 is not limited to the aforementioned configuration. For example, the flow switching device 13 may be omitted.

A refrigeration cycle apparatus 10 according to Embodiment 8 includes a refrigerant circuit 11 in which the compressor 12, an evaporator (e.g. an indoor heat exchanger 16), a pressure reducing device 15, and a condenser (e.g. an outdoor heat exchanger 14) are connected via refrigerant pipes. According to this configuration, including the compressor 12 with a reduction in abrasion on sliding parts by foreign matter 8 brings about improvement in reliability of the refrigeration cycle apparatus 10.

REFERENCE SIGNS LIST

1: bearing structure, 2: bearing, 3: shaft, 3*a*: first element, 3*b*: second element, 3*c*: crowning portion, 3*d*: cylindrical portion, 5: main oil feed hole, 6: branch oil feed hole, 6*a*: branch oil feed wall inner wall, 7*a*: foreign matter separating space, 7*a*1: space, 7*b*: foreign matter separating wall, 7*b*1: wall portion, 7*c*: foreign matter separating wall forming element, 8: foreign matter, 9: sleeve, 10: refrigeration cycle apparatus, 11: refrigerant circuit, 12: compressor, 13: flow switching device, 14: outdoor heat exchanger, 15: pressure reducing device, 16: indoor heat exchanger, 21: inner circumferential surface, 30: eccentric portion, 31: inner wall, 31*a*: inner wall portion, 32: outer circumferential portion, 32*a*: first outer circumferential recessed portion, 32*b*: second outer circumferential recessed portion, 32*c*: foreign matter storage groove, 32*d*: foreign matter drain groove, 32*e*: foreign matter drain space, 32*f*: foreign matter drain hole, 32*fo*: exit, 320: outlet, 32*r*: inner wall portion, 32*s*: side surface, 33 inner circumferential surface, 35*a*: first planar portion, 35*b*: second planar portion, 35*c*: upper surface portion, 36*a*: first fitting portion, 36*b*: second fitting portion, 61: shaft oil feed hole, 62: sleeve oil feed hole, 63: oil feed space, 91: inner circumferential surface, 92: outer circumferential portion, 920: outlet, 101: fixed scroll, 102: orbiting scroll, 103: closed vessel, 104: main bearing, 105: orbiting bearing, 106: slider, 107: crank shaft, 108: oil sump, 109: suction port, 110: discharge port, 111: oil feed pump, 200: cutting tool, Ax: axis, G: gap

The invention claimed is:

1. A bearing structure for use in a rotary machine, the bearing structure comprising:

a rotor having a cylindrical shape and having a main oil feed hole through which lubricating oil passes and that is provided in an axial direction; and a slide bearing provided outward in a radial direction with a gap between the rotor and the slide bearing and configured to hold the rotor so that the rotor rotates around an axis, wherein the rotor is provided with a branch oil feed hole through which the gap and the main oil feed hole communicate with each other and through which the lubricating oil passes, a foreign matter separating portion in which foreign matter is separated from the lubricating oil is provided further backward in a direction of rotation than the branch oil feed hole, the rotor is constituted by a cylindrically shaped shaft and a cylindrically shaped sleeve fitted onto an outer circumferential portion of the shaft and configured to rotate with the shaft, the branch oil feed hole of the rotor includes a shaft oil feed hole provided in the shaft, and a sleeve oil feed hole provided in the sleeve, a first outer circumferential recessed portion formed by a recess in the outer circumferential portion of the shaft is provided backward in the direction of rotation at an opening edge of the shaft oil feed hole, and the foreign matter separating portion is formed by the first outer circumferential recessed portion of the shaft and an inner circumferential surface of the sleeve.

2. The bearing structure of claim 1, wherein in a circumferential direction of the rotor, the sleeve oil feed hole is provided in a location that is identical to that of the shaft oil feed hole, and the branch oil feed hole of the rotor is constituted by the shaft oil feed hole and the sleeve oil feed hole.

3. The bearing structure of claim 1, wherein in a circumferential direction of the rotor, the sleeve oil feed hole is provided further forward in the direction of rotation than the shaft oil feed hole, a second outer circumferential recessed portion formed by a recess in the outer circumferential portion of the shaft is provided forward in the direction of rotation at the opening edge of the shaft oil feed hole, an oil feed space is formed by the second outer circumferential recessed portion of the shaft and the inner circumferential surface of the sleeve, and the branch oil feed hole of the rotor is constituted by the shaft oil feed hole, the sleeve oil feed hole, and the oil feed space.

4. The bearing structure of claim 3, wherein in a portion of the outer circumferential portion of the shaft covered with the sleeve, foreign matter storage grooves are provided at a distance from the opening edge of the shaft oil feed hole and at both ends of the opening edge in the axial direction, the first outer circumferential recessed portion and the second outer circumferential recessed portion are provided in continuity and provided astride two of these foreign matter storage grooves in the axial direction, and the shaft oil feed hole intersects at an angle with side surfaces of the first outer circumferential recessed portion and the second outer circumferential recessed portion and is inclined backward in the direction of rotation.

5. The bearing structure of claim 4, wherein in the portion of the outer circumferential portion of the shaft covered with the sleeve, the foreign matter storage grooves and a foreign matter drain space through which the foreign matter storage grooves and an outside of the portion of the outer circumferential portion of the shaft communicate with each other are formed.

6. The bearing structure of claim 1, wherein foreign matter storage grooves provided away from the first outer circumferential recessed portion in the axial direction and foreign matter drain grooves through which the first outer circumferential recessed portion and the foreign matter storage grooves communicate with each other are formed in a portion of the outer circumferential portion of the shaft covered with the sleeve.

7. The bearing structure of claim 6, wherein a crowning portion in which the outer circumferential portion of the shaft is barreled is provided in part of the shaft in the axial direction, the shaft oil feed hole and the first outer circumferential recessed portion are provided in the crowning portion of the shaft, the sleeve is fitted on the outer circumferential portion of the shaft to cover an outer circumference of the crowning portion, and the foreign matter storage grooves are provided at ends of the crowning portion in the axial direction.

8. The bearing structure of claim 1, wherein in a portion of the outer circumferential portion of the shaft covered with the sleeve, foreign matter storage grooves are provided at a distance from the opening edge of the shaft oil feed hole and at both ends of the opening edge in the axial direction, and the first outer circumferential recessed portion is provided astride two of these foreign matter storage grooves in the axial direction.

9. The bearing structure of claim 1, wherein a crowning portion in which the outer circumferential portion of the shaft is barreled is provided in part of the shaft in the axial direction, the shaft oil feed hole and the first outer circumferential recessed portion are provided in the crowning portion of the shaft, and the sleeve is fitted on the outer circumferential portion of the shaft to cover an outer circumference of the crowning portion.

* * * * *